US006909411B1

(12) United States Patent
Yamazaki et al.

(10) Patent No.: US 6,909,411 B1
(45) Date of Patent: Jun. 21, 2005

(54) DISPLAY DEVICE AND METHOD FOR OPERATING THE SAME

(75) Inventors: Shunpei Yamazaki, Tokyo (JP); Jun Koyama, Kanagawa (JP); Masaaki Hiroki, Kanagawa (JP); Munehiro Azami, Kanagawa (JP); Mitsuaki Osame, Kanagawa (JP); Yutaka Shionoiri, Kanagawa (JP); Shou Nagao, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 96 days.

(21) Appl. No.: 09/619,478

(22) Filed: Jul. 19, 2000

(30) Foreign Application Priority Data

Jul. 23, 1999 (JP) ..... 11-209447

(51) Int. Cl.[7] ..... G09G 3/36

(52) U.S. Cl. ..... 345/87; 345/98

(58) Field of Search ..... 345/204, 87, 89, 345/103, 104, 96, 98, 205

(56) References Cited

U.S. PATENT DOCUMENTS

| | | | | |
|---|---|---|---|---|
| 5,594,569 A | | 1/1997 | Konuma et al. | |
| 5,643,826 A | | 7/1997 | Ohtani et al. | |
| 5,793,334 A | * | 8/1998 | Anderson et al. | 345/87 |
| 5,923,962 A | | 7/1999 | Ohtani et al. | |
| 6,008,801 A | * | 12/1999 | Jeong | 345/204 |
| 6,025,835 A | * | 2/2000 | Aoki et al. | 345/204 |
| 6,078,317 A | * | 6/2000 | Sawada | 345/204 |
| 6,097,362 A | * | 8/2000 | Kim | 345/87 |
| 6,507,332 B1 | * | 1/2003 | Kuwabara et al. | 345/103 |

FOREIGN PATENT DOCUMENTS

| | | |
|---|---|---|
| EP | 0 938 074 A1 | 8/1999 |
| EP | 1 006 664 A2 | 6/2000 |
| JP | 07-130652 | 5/1995 |
| JP | 11-167373 | 6/1999 |
| JP | 2000-341125 | 12/2000 |

OTHER PUBLICATIONS

Furue et al., "Characteristics and Driving Scheme of Polymer–Stabilized Monostable FLCD Exhibiting Fast Response Time and High Contrast Ratio with Gray–Scale Capability", SID 98 Digest, pp. 782–785.

Yoshida et al., "A Full–Color Thresholdless Antiferroelectric LCD Exhibiting Wide Viewing Angle with Fast Response Time", SID 97 Digest, pp. 841–844.

Inui et al., "Thresholdless Antiferroelectricity in liquid crystals and its application to displays", J. Mater. Chem., 1996, 6(4), pp. 671–673.

(Continued)

*Primary Examiner*—Chanh Nguyen
*Assistant Examiner*—Uchendu O Anyaso
(74) *Attorney, Agent, or Firm*—Nixon Peabody LLP; Jeffrey L. Costellia

(57) ABSTRACT

To provide a display device capable of displaying a good quality image. According to the present invention, there is provided a display device comprising:

a display panel composed of a pixel portion in which a plurality of TFTs are arranged in matrix, a source driver, and a gate driver;

an image signal processing circuit for processing an image signal input from an external; and a control circuit for controlling the display panel and the image signal processing circuit, characterized in that the image signal processing circuit corrects the image signal on the basis of a correction table and feeds the display panel with the corrected image signal.

32 Claims, 17 Drawing Sheets

OTHER PUBLICATIONS

Koyama et al., "A 4.0–in. Poly Si TFT–LCD with Integrated 6–bit Digital Data Driver Using CGS Technology.", Jul. 14–16, 1999, pp. 29–32, AM–LCD 99, International Workshop on Active–Matrix Liquid–Crystal Displays, Digest of Technical Papers.

Ohtani et al., "LP–B: Late–News Poster: A 60–in. HDTV Rear–Projector with Continuous–Grain–Silicon Technology", May 17–22, 1998, pp. 467–470, SID 98 Digest vol. XXIX.

Matsueda et al., "30.1: A 6–bit Color VGA Low–Temperature Poly–Si TFT–LCD with Integrated Digital Data Drivers", May 17–22, 1998, pp. 879–882, SID 98 Digest, vol. XXIX.

Koyama et al., "30.2: A 4.5–in. Full–Color VGA Poly–Si TFT–LCD with Integrated Drivers", May 17–22, 1998, pp. 883–886, SID 98 Digest, vol. XXIX.

Osame et al., "40.1: A 2.6–in. Poly–Si TFT–LCD HDTV Display with Monolithic Integrated 8–bit Digital Data Drivers", May 17–22, 1998, pp. 1059–1062, SID 98 Digest, vol. XXIX.

Azami et al., "4.1: A 2.6–in. DTV TFT–LCD with Area–Reduced Integrated 8–bit Digital Data Drivers Using 400–Mobility CGS Technology", May 18–20, 1999, pp. 6–9, SID 99 Digest, vol. XXX.

Matsueda et al., "4.2: Low–Temperature Poly–Si TFT–LCD with Integrated 6–bit Digital Data Drivers", May 12–17, 1996, pp. 21–24, SID 96 Digest, vol. XXVII.

Azami et al., Translation of "CGS–TFT–LCD as a Display Element for a Projector", 1999, pp. 1–8 (trans.), pp. 76–79 (article), FPD Intelligence 11.

* cited by examiner

DISPLAY DEVICE AND METHOD FOR OPERATING THE SAME

BACKGROUND OF THE INVENTION

1. Field of the Invention

The present invention relates to a display device and method for operating the same. Specifically, the invention relates to a display device using an active matrix type liquid crystal panel. Note that the present invention is also applicable to a display device having a display panel that uses as a display medium other material than liquid crystal.

2. Description of the Related Art

Rapid development has been made in recent years in a technique for manufacturing a semiconductor device, for example, a thin film transistor (TFT), which has a semiconductor thin film formed on an inexpensive glass substrate. This is because there is an increasing demand for active matrix type liquid crystal display devices (liquid crystal panels).

In an active matrix type liquid crystal display device, a TFT is disposed in each of several hundred thousands to several million pixels which are arranged in matrix in a pixel region, and electric charge flowing in and out of each pixel electrode is controlled by switching function owned by the TFTs.

In the pixel region, thin film transistors using amorphous silicon formed on a glass substrate are arranged.

A structure is known in which quartz is utilized as a substrate and thin film transistors are fabricated from a polycrystalline silicon film. In this case, the thin film transistors formed on the quartz substrate are used to form both of a peripheral driver circuit and a pixel portion.

Also known is a technique in which thin film transistors using a crystalline silicon film are formed on a glass substrate by laser annealing or other technologies. Employment of this technique allows of integrating a pixel portion and a peripheral driver circuit on the glass substrate.

The active matrix type liquid crystal panels have lately been adopted in many notebook type personal computers. In personal computers, multi-gray scale liquid crystal panels are needed in order to, e.g., simultaneously start a plurality of software, or process images taken in from a digital camera.

The demand for liquid crystal projectors for a large screen that is capable of displaying thereon images by High-vision (a broadcast standard developed by NHK) signals has been growing. It is true also for such projectors that the quality of displayed images depends on how fine the gray scale display is.

As just has been mentioned, a key factor for providing a high quality image is how finely the gray scale display can be set. There are two types of gray scale display, one is to feed a source line with an analog signal such as a video signal or a television signal (analog gray scale), and the other is to feed the source line with a digital signal such as a data signal output by a personal computer (digital gray scale).

In analog gray scale, as described above, analog image signals to be fed to image signal lines are sequentially selected in response to a signal from a source driver, and predetermined image signals are fed to corresponding source lines.

In digital gray scale, digital signals to be fed to the image signal lines are sequentially selected and subjected to D/A conversion, and then predetermined image signals are fed to corresponding source lines.

A relation as expressed by the dotted line in FIG. 17 is established between voltage (V) applied to liquid crystal and the intensity of transmitting light in liquid crystal panels irrespective of the type of gray scale display, provided that the liquid crystal panels use normally white mode in which the panels are bright when voltage is not applied in TN (twist nematic) mode.

As can tell from FIG. 17, a nonlinear relation is found between the voltage applied to the liquid crystal and the intensity of transmitting light which is the cause of difficulty in making the fineness of gray scale display respond to the magnitude of the applied voltage. Therefore, images cannot be accurately reproduced from image signals input from an external, and to provide good quality images is difficult.

SUMMARY OF THE INVENTION

The present invention has been made in view of the above, and an object of the present invention is therefore to provide a display device and method capable of excellent gray scale display.

According to the present invention, there is provided a display device comprising:

a display panel composed of a pixel portion in which a plurality of TFTs are arranged in matrix, a source driver, and a gate driver;

an image signal processing circuit for processing an image signal input from an external; and a control circuit for controlling the display panel and the image signal processing circuit, characterized in that the image signal processing circuit corrects the image signal on the basis of a correction table and feeds the display panel with the corrected image signal.

According to the present invention, there is provided a display device comprising:

a display panel composed of a pixel portion in which a plurality of TFTs are arranged in matrix, a source driver, and a gate driver;

an image signal processing circuit for processing an image signal input from an external; and a control circuit for controlling the display panel and the image signal processing circuit, characterized in that the image signal processing circuit performs gamma correction on the image signal on the basis of a correction table and feeds the display panel with the image signal on which gamma correction has been performed.

The display panel may be a liquid crystal display panel.

The source driver may be a digital driver with a D/A conversion circuit.

DETAILED DESCRIPTION OF THE PREFERRED EMBODIMENTS

Figure 1:
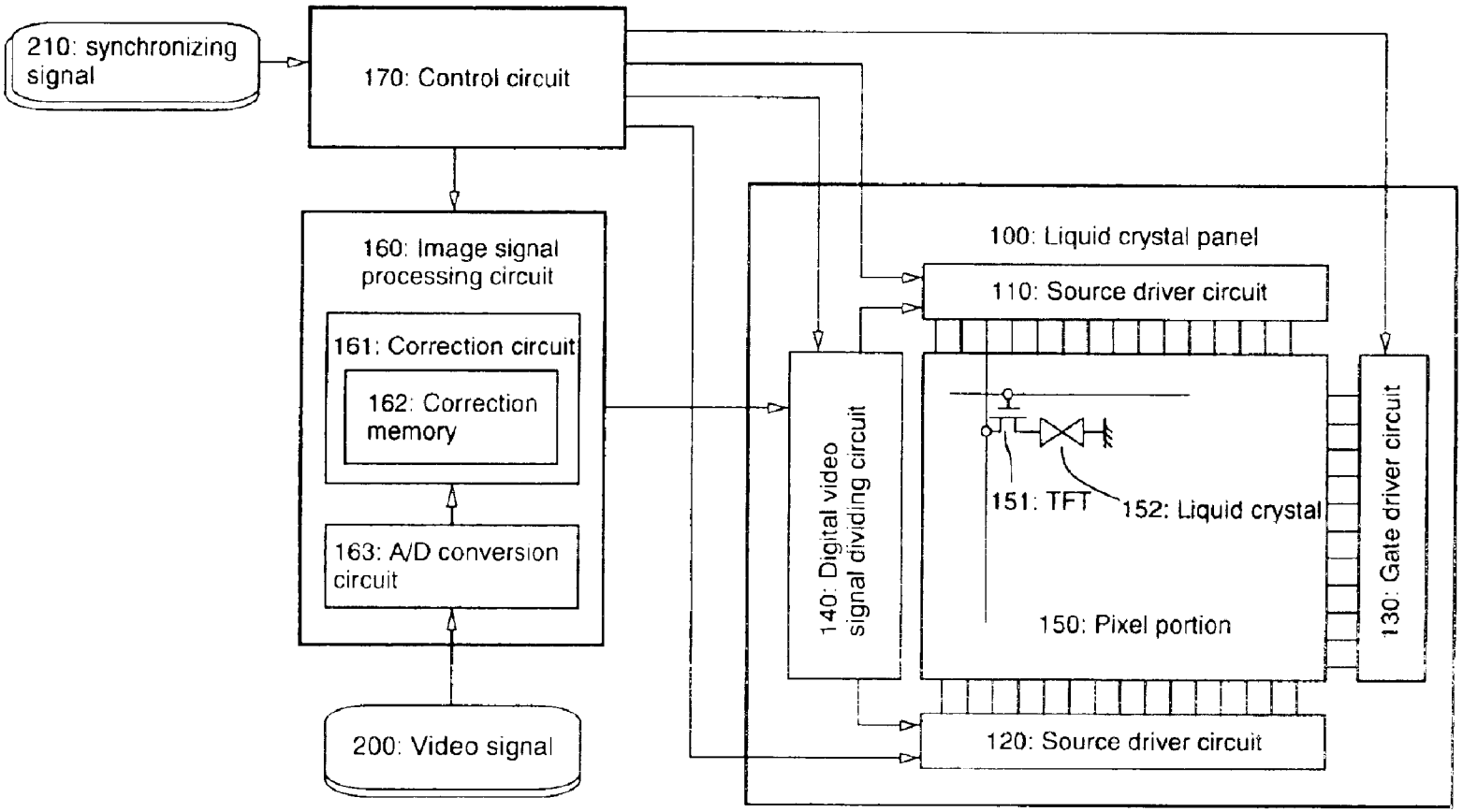
FIG. 1 is a circuit block diagram in an embodiment mode of a display device according to the present invention.

An embodiment mode of the present invention is shown in FIG. 1. In FIG. 1, reference numeral 100 denotes a liquid crystal panel that has source drivers 110, 120, a gate driver 130, a digital video signal dividing circuit 140, and a pixel portion 150. The pixel portion 150 includes pixels arranged in matrix, and each pixel is composed of a TFT 151, a pixel electrode, etc. The liquid crystal panel is obtained by bonding to an opposite substrate an active matrix substrate, on which the source drivers 110, 120, the gate driver 130, the digital video signal dividing circuit 140, and the pixel portion 150 are formed, so as to sandwich liquid crystal 152 between the substrates. Note that, although the explanation is given here taking as an example a liquid crystal panel, the invention is not limited to this example and any display panel using other display medium may be employed as long as the medium has an electro-optical characteristic that changes in accordance with an -applied voltage. In addition, a liquid crystal panel having an analog driver may also be used, though the explanation in this embodiment mode is about a liquid crystal panel having a digital driver.

Reference numeral 160 denotes an image signal processing circuit that is comprised of an A/D conversion circuit 163 for converting an analog video signal 200 input from an external into a digital image signal, and a correction circuit 161 for correcting a digital video signal. The correction circuit 161 has a correction memory 162. In a display device of the present invention, a digital video signal is corrected on the basis of a correction table stored in the correction memory.

A control circuit 170 controls various kinds of signals to be fed to the liquid crystal panel 100 and the image signal processing circuit 160. A synchronizing signal is input to the control circuit 170.

The image signal processing circuit 160, the control circuit 170 and other circuits are mounted on a separate substrate from the liquid crystal panel 100, for instance, on a different printed board, and are connected to the liquid crystal panel 100 through cables or flexible wiring boards. Needless to say, some or all of these circuits including the image processing circuit 160 and the control circuit 170 are preferably formed on the same substrate as the liquid crystal panel because it contributes to integration.

The control circuit 170 is a circuit for generating and feeding, on the basis of a synchronizing signal 210, pulses (such as a start pulse, a clock pulse, and a synchronizing signal) that are necessary for controlling operation timing of the source driver circuits 110, 120, the gate driver circuit 130, the digital video signal dividing circuit 140, the image signal processing circuit 160, etc.

Input to the digital video signal dividing circuit 140 are a digital image signal corrected by the image signal processing circuit 160, and signals from the control circuit.170, such as a start pulse signal, a clock signal, and a horizontal synchronizing signal.

The control circuit 170 repeats an operation (frequency division) of counting clocks to a preset count number (frequency division ratio), using the input synchronizing signal 210 as reference and assigning to a primal oscillation an oscillation clock signal (OSC) that is output from a phase-locked oscillator. The clock is counted at the same time as the frequency division to generate: a start pulse (S_SP) and a clock pulse (S_CK) which are to be fed to the source driver circuits and which are for the horizontal direction of a screen; a start pulse (G_SP) and a clock pulse (G_CK) which are to be fed to the gate driver circuit and which are for the vertical direction of the screen; and a clock pulse (D_CK) to be fed to the digital video signal dividing circuit. In some cases, a horizontal synchronizing signal (HSY) and a vertical synchronizing signal (VSY) may be generated additionally.

The video signal 200 input from the external to the image signal processing circuit 160 is an analog signal. In the image signal processing circuit 160, the video signal 200 is converted into a digital video signal by the A/D conversion circuit 163 and is output to the correction circuit 161. The correction circuit 161 performs γ correction on the input digital video signal, based on a correction table stored in the correction memory and taking into consideration a liquid crystal characteristic, to thereby improve a gray scale or other characteristic. The corrected digital video signal is fed to the digital video signal dividing circuit of the liquid crystal panel 100.

Figure 2:
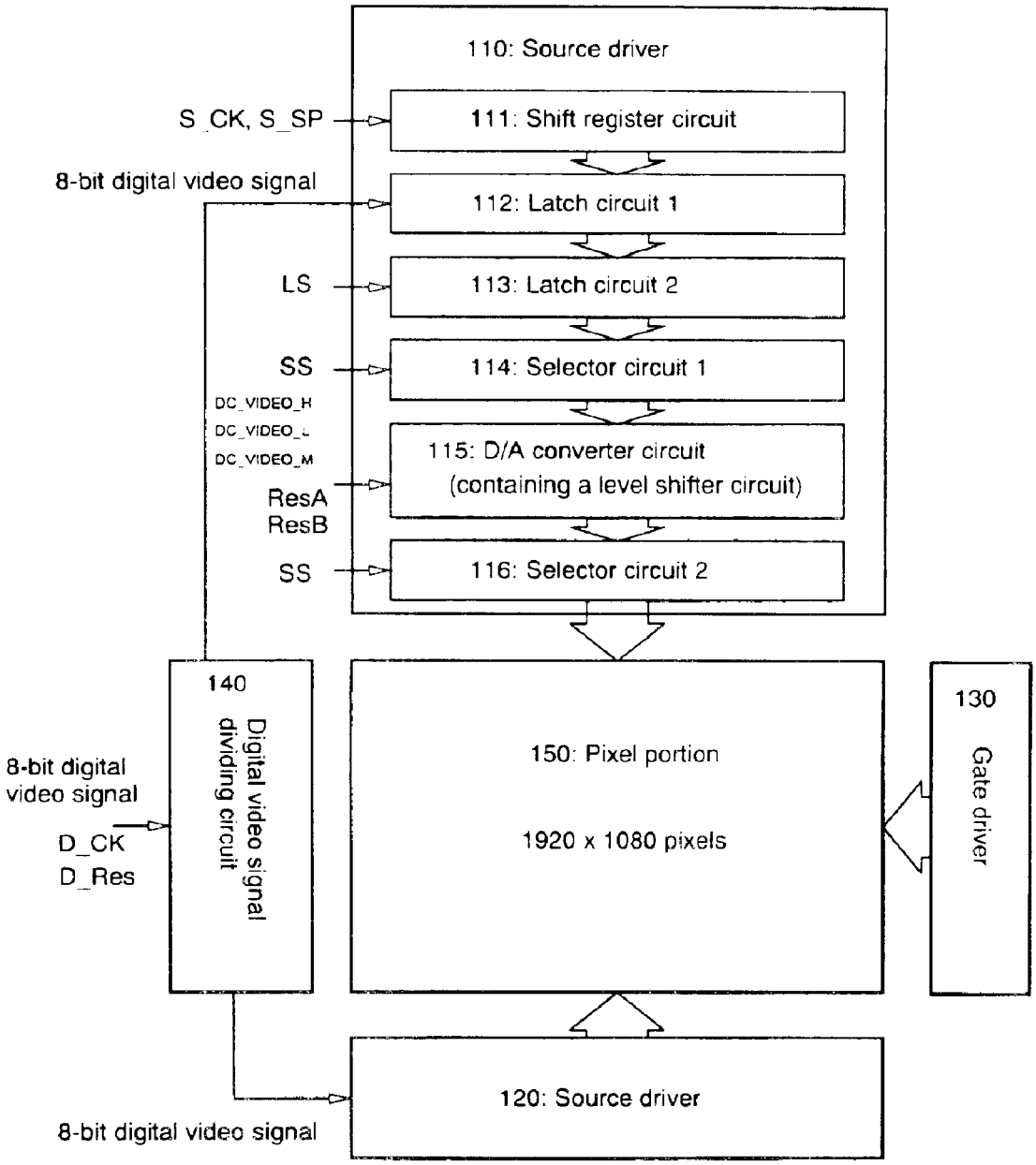
FIG. 2 is a circuit block diagram of a liquid crystal panel in the embodiment mode of a display device according to the present invention.

Now, reference is made to FIG. 2. FIG. 2 shows in block diagram details of the liquid crystal panel 100 according to this embodiment mode.

The source driver 110 is composed of a shift register circuit (shift register circuits of 240 stages×2) 111, a latch circuit 1 (digital latch circuits of 960×8) 112, a latch circuit 2 (digital latch circuits of 960×8) 113, a selector circuit 1 (240 selector circuits) 114, a D/A conversion circuit (240 DACs) 115, and a selector circuit 2 (240 selector circuits) 116. In addition thereto, the source driver 110 has a buffer circuit and a level shifter circuit (neither is shown). For conveniences' sake of explanation, the level shifter circuit is assumed to be included in the D/A conversion circuit 115.

The source driver 120 has the same structure as that of the source driver 110. The source driver 110 feeds odd-numbered source signal lines with a video signal (gray scale voltage signal), while the source driver 120 feeds even-numbered source signal lines with a video signal.

Two source drivers 110 and 120 are arranged so that the pixel portion is held by them at the top and at the bottom in the liquid crystal panel 100 of this embodiment mode, in favor of circuit layout. However, only one source driver may be disposed if it is possible in the light of circuit layout.

A description is given here on the operation of the liquid crystal panel 100 and the flow of signals according to this embodiment.

A clock signal (S_CK) and a start pulse (S_SP) are input to the shift register circuit 111. The shift register circuit 111 sequentially generates timing signals on the basis of the clock signal (S_CK) and the start pulse (S_SP) to sequentially feed the timing signals to downstream circuits through the buffer circuit (not shown) and the like.

The timing signals from the shift register circuit are buffered by the buffer circuit or the like. The load capacitance (parasitic capacitance) is large since a large number of circuits or elements are connected to the source signal lines to which the timing signals are fed. The buffer circuit is provided to prevent sharp rise or fall of the timing signals to be dulled due to this large load capacitance.

The timing signals buffered by the buffer circuit are then fed to the latch circuit 1 (112). The latch circuit 1 (112) has 960 stages of latch circuits for processing an 8 bit digital video signal. The latch circuit 1 (112) sequentially takes in and holds 8 bit digital signals fed from the digital video signal dividing circuit upon input of the timing signals.

The time necessary to complete writing of the digital video signals into all the stages of latch circuits of the latch circuit 1 (112) is called a line term. More specifically, the line term is defined as a time interval from the start of writing the digital video signals into the latch circuit of the left most stage to the end of writing the digital video signals into the latch circuit of the right most stage. In effect, horizontal retrace term added to the above-defined line term may also be referred to as the line term.

After one line term is ended, a latch signal (LS) is fed to the latch circuit 2 (113) to coincide with the operation timing of the shift register circuit 111. In this moment, the digital do video signals written in and held by the latch circuit 1 (112) are sent all at once to the latch circuit 2 (113) to be written in and held by all stages of the latch circuit 2 (113).

The latch circuit 1 (112), after sending the digital video signals to the latch circuit 2 (113), again accepts sequential writing in of digital video signals newly fed from the digital video signal dividing circuit, in response to timing signals from the shift resister circuit 111.

During this second time one line term, the digital video signals written in and held by the latch circuit 2 (113) are sequentially selected by the selector circuit 1 (114), and fed to the D/A conversion circuit 115. In the selector circuit 1 (114) of this embodiment mode, every single selector circuit handles four source signal lines.

A selector circuit disclosed in Japanese Patent Application No. Hei 9-286098 filed by the applicant of the present invention may be used instead.

In this embodiment mode, one selector circuit is provided for every four source signal lines. 8 bit digital video data fed from the latch circuit 1 (112) to a corresponding source signal line is selected at every quarter of one line scanning term.

The 8 bit digital video data selected by the selector circuit 114 is fed to the D/A conversion circuit 115. A description is given here on the D/A conversion circuit used in this embodiment mode with reference to FIG. 3 and FIGS. 4A and 4B.

Figure 3:
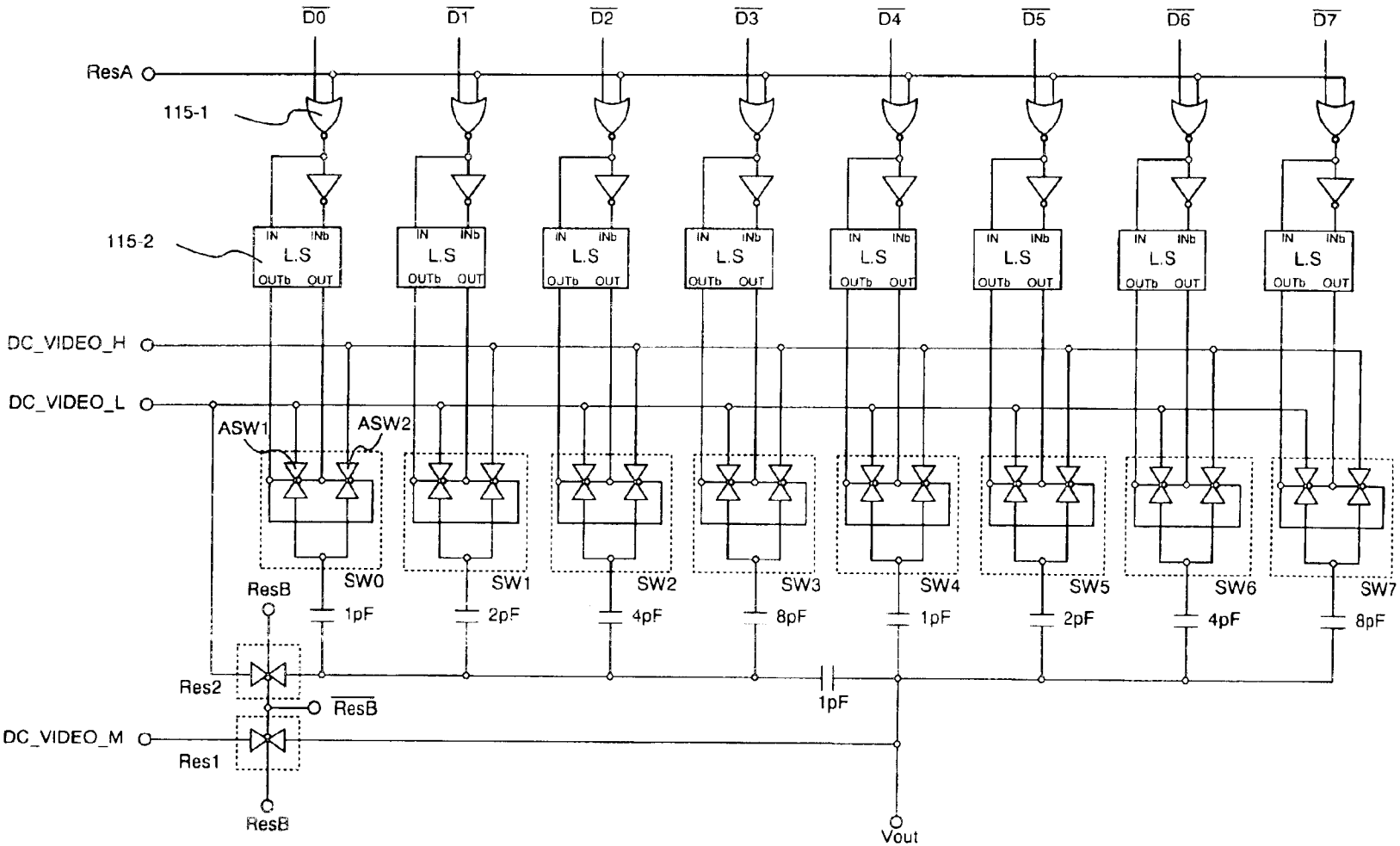
FIG. 3 is a circuit diagram showing a D/A conversion circuit of a liquid crystal panel in the embodiment mode of a display device according to the present invention.
Figure 4A:
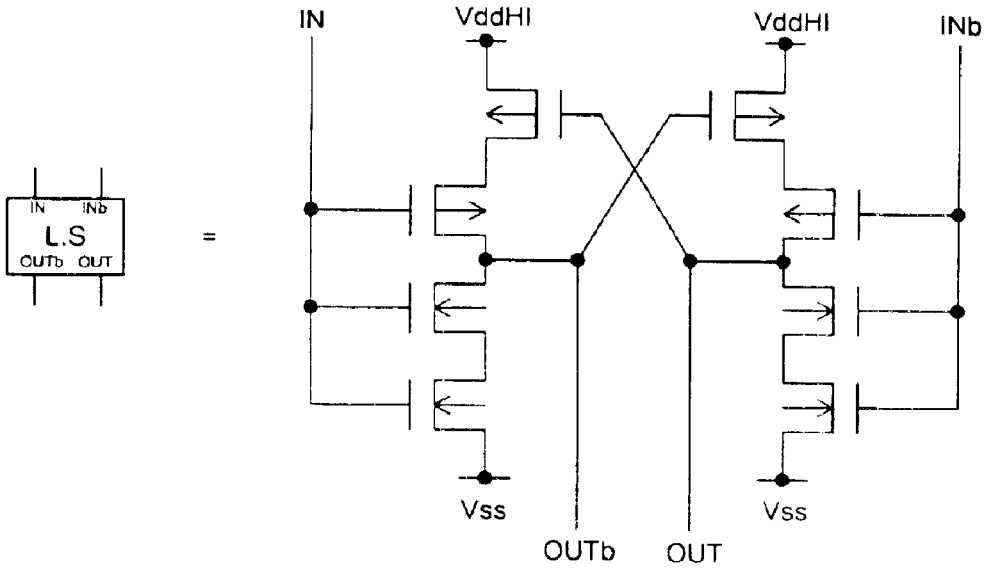
FIGS. 4A and 4B are circuit diagrams showing a level shifter and an analog switch, respectively, of a D/A conversion circuit of a liquid crystal panel in the embodiment mode of a display device according to the present invention.

FIG. 3 shows a circuit diagram of the DIA conversion circuit according to this embodiment mode. Note that it is possible to design the D/A conversion circuit omitting the level shifter circuit (L.S.) (115-2) though the D/A conversion circuit of this embodiment mode has the level shifter circuit (L.S.) (115-2). The circuit structure of the level shifter circuit (L.S.) (115-2) is shown in FIG. 4A. In the level shifter circuit, a high potential power source VddHI is output from an output OUT and a low potential power source Vss is output from an output OUTb when a signal Lo is input to an input IN and a signal Hi is input to an input INb. When a signal Hi is input to the input IN and a signal Lo is input to the input INb, a low potential power source Vss is output from the output OUT and a high potential power source VddHI is output from the output OUTb.

In the D/A conversion circuit according to this embodiment mode, inversion data (called inversions D0 to D7 in here) of 8 bit digital video signals (D0 to D7) are input to one of inputs of an NOR circuit (115-1). The other input of this NOR circuit (115-1) receives a reset pulse A (ResA). This reset pulse A is input during a reset term TR for resetting the D/A conversion circuit. In this embodiment mode, the digital video signals (inversions D0 to D7) is input to the NOR circuit (115-1) also in the reset term TR, but the digital video signals is not output from the NOR circuit during a period in which the reset pulse ResA is input to the NOR circuit.

The NOR circuit may be omitted, in which case the digital video signals (inversions D0 to D7) is input after the reset term TR has been ended.

When the reset term TR has passed, a data writing period TE is started during which 8 bit digital video signals are increased in voltage level by the level shifter circuit and are input to switch circuits SW0 to SW7.

Figure 4B:
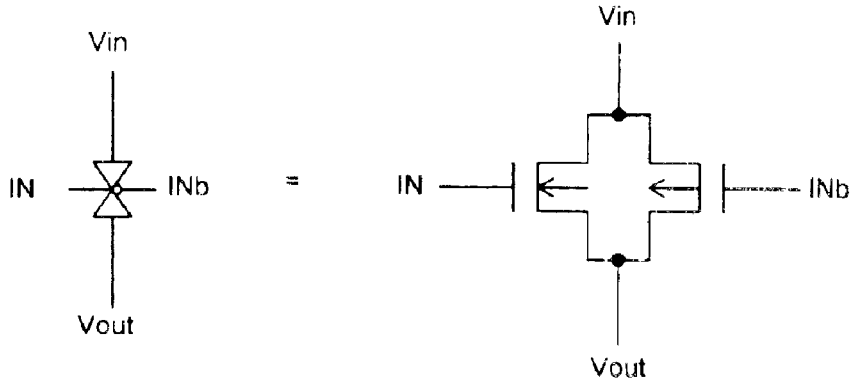

The switch circuits SW0 to SW7 are each composed of two analog switches ASW1 and ASW2. The circuit structure of the analog switches ASW1, ASW2 is shown in FIG. 4B. One terminal of each ASW1 is connected to DC_VIDEO_L whereas the other terminal thereof is connected to one terminal of each ASW2 and to a capacitor. One terminal of each ASW2 is connected to DC_VIDEO_H whereas the other terminal thereof is connected to one terminal of each ASW2 and to a capacitor (1 pF, 2 pF, 4 pF, 8 pF, 1 pF, 2 pF, 4 pF, 8 pF, in this embodiment mode, but not limited thereto). One terminal of each capacitor is connected to two analog switches whereas the other terminal thereof is connected to a reset switch 2 (Res2). One terminal of each reset switch 1 (Res1) is connected to DC_VIDEO_M whereas the other terminal thereof is connected to one terminal of each capacitor that corresponds to upper bit. A reset pulse (ResB) and an inversion reset pulse (inversion ResB) are input to do the reset switches Res1, Res2.

A capacitor (1 pF) is provided at a junction point between a circuit corresponding to upper bit and a circuit corresponding to lower bit. The numerical values mentioned in connection with the capacitors in this embodiment mode are provided as an example, not as a limitation.

The D/A conversion circuit 115 converts the 8 bit digital video signals into analog video signals (gray scale voltage), so that the converted signals are sequentially fed to source signal lines selected by the selector circuit 2 (116). Japanese Patent Application No. Hei 11-77846 filed by the applicant of the present invention may be referred to for details of the D/A conversion circuit used in this embodiment mode.

The analog signals fed to the source signal lines are fed to source regions of pixel TFTs in the pixel portion connected to the source signal lines.

In the gate driver 130, timing signals sent from the shift register (not shown) are fed to the buffer circuit (not shown) and then to corresponding gate signal lines (scanning lines). The gate signal lines are connected to gate electrodes of the pixel TFTs of one line and all the pixel TFFs of one line have to be turned ON simultaneously, requiring the use of a buffer circuit with a large current capacity.

In this way, a corresponding pixel TFT is switched by a scanning signal sent from the gate driver, and the analog signals (gray scale voltage) sent from the source driver are fed to the pixel TFTs to drive liquid crystal molecules.

Reference numeral 140 denotes a digital video signal dividing circuit (SPC; Serial-to-Parallel Conversion Circuit). The digital video signal dividing circuit 140 is a circuit to drop to 1/m (m: integer) the frequency of a digital video signal input from an external device (from the image signal processing circuit 160) placed outside the liquid crystal panel 100. By dividing the digital video signal input from the external, the frequency of a signal necessary for operation of the driver circuit can also be dropped to 1/m.

In this embodiment mode, 8 bit digital video signals of 80 MHz are input from the external to the digital video signal dividing circuit 140. The digital video signal dividing circuit 140 performs serial-parallel conversion on the 8 bit digital video signals of 80 MHz input from the external, and feeds the source drivers 110, 120 with digital video signals of 10 MHz.

In addition to the digital video signals of 80 MHz, a clock of 40 MHz (D_CK) and a reset pulse (D_Res) are input from the external to the digital video signal dividing circuit 140 of this embodiment mode. The digital video signal dividing circuit 140 of this embodiment mode requires merely a clock whose frequency is half the frequency of the input digital video signal. Therefore, the digital video signal dividing circuit 140 of this. embodiment mode is high in stableness and reliability as compared with conventional digital video signal dividing circuits.

Described next is a method of creating a correction table of the correction memory in the correction circuit included in the image signal processing circuit 160 of the display device according to the present invention.

Figure 5:
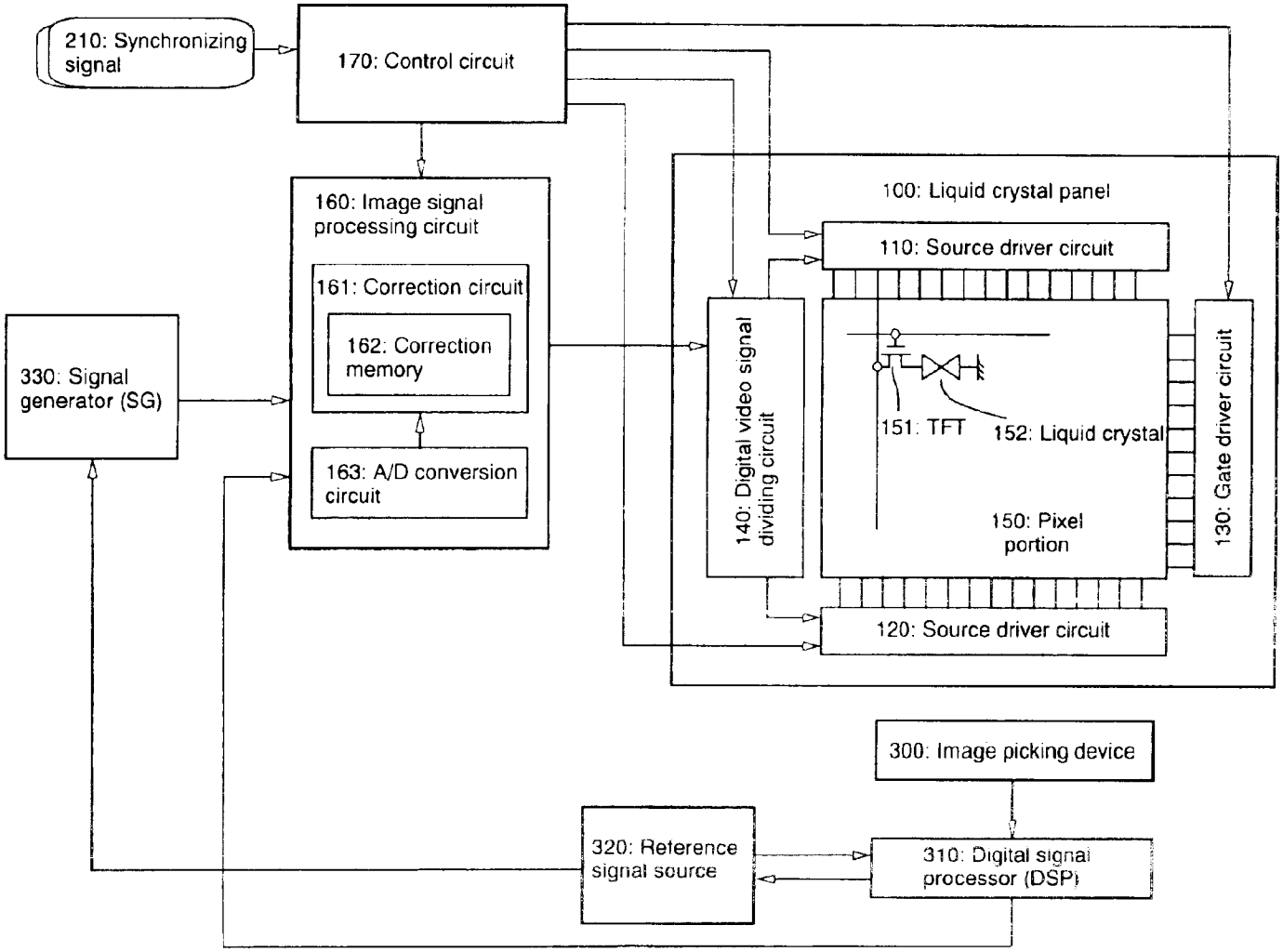
FIG. 5 is a circuit block diagram in the embodiment mode of a display device according to the present invention.

Reference is made to FIG. 5. FIG. 5 is a circuit block diagram showing the structure for creating the correction table of the correction memory in the correction circuit of the image signal processing circuit 160 of the display device according to the present invention. Denoted by 300 is an image picking device, which converts an image displayed on the liquid crystal panel into an electric signal. A CCD camera, a digital video camera, or other image picking devices may be used for the image picking device 300. Alternatively, a luminance measuring device, or an illuminometer, for simply measuring the brightness and the luminance of a displayed image may be used for the image picking device 300. If the luminance measuring device or the illuminometer is employed, it is appropriate to use an A/D conversion circuit for converting signals fed from the measuring device or the meter into digital signals.

Reference numeral 310 denotes a digital signal processor (DSP), 320, a reference signal source, and 330, a signal generator (SG). For conveniences' sake of explanation, polarizing plates arranged so as to sandwich the liquid crystal panel 100 are omitted from the drawing.

The signal generator (SG) denoted by 330 feeds digital signals. The correction circuit 161 of the image signal processing circuit 160 performs γ correction on the digital signals fed from the signal generator 330, and sends the corrected digital signals to the liquid crystal panel 100. The liquid crystal panel 100 displays an image on the basis of the digital signals fed from the image signal processing circuit 160.

The displayed image is converted into a digital signal, using the image picking device 300. The digital signal sent from the image picking device 300 is fed to the digital signal processor (DSP) 310. The digital signal processor 310 compares the digital signal fed from the image picking device 300 with the digital signal fed from the reference signal source 320, and feeds back the difference between two data to the correction circuit 161. The reference data may be fed directly from the signal generator 330 instead.

The correction circuit 161 further corrects the digital signal from the signal generator 330 in accordance with the signal fed from the digital signal processor 310, and then sends the corrected signal to the liquid crystal panel again. The liquid crystal panel 100 displays an image on the basis of the digital signal fed from the image signal processing circuit 160.

The displayed image is again converted into a digital signal, using the image picking device 300. The digital signal fed from the image picking device 300 is sent to the digital signal processor 310. The digital signal processor 310 compares the digital signal fed from the image picking device 300 with the digital signal fed from the reference signal source 320, and feeds back once more the difference between two data to the correction circuit 161.

The above operation is repeated until a proper data of gamma correction is obtained. For instance, when a digital signal for generating a 10% gray scale voltage of the maximum voltage applied to pixels is fed from the signal generator 330, the above operation is repeated over and over again until the intensity of an image displayed in the pixel region gains 10% (or approximately 10%) of the intensity that is obtained when the maximum voltage is applied.

When the proper data of gamma correction is obtained, the data is stored at a specified address in the correction memory 162.

Thereafter, in order to start the correction of the next digital signal, the signal generator 330 sends to the correction circuit 161 a digital signal different from the previous one. The above operation is repeated to obtain a proper data of gamma correction with respect to the digital signal concerned, and the proper data is stored at a specified address in the correction memory 162.

After data of gamma correction of the digital signals are all stored in the correction memory 162, the signal generator 330 and the digital signal processor 310 are disconnected from the liquid crystal panel 100, which completes the creation of the correction table for gamma correction.

Then the digital signals are fed to the correction circuit 160, receive gamma correction based on the gamma correction table stored in the correction memory 161, and are fed to the liquid crystal panel 100. Having thus been corrected properly, the digital signals fed to the liquid crystal panel 100 produce a good quality image on the liquid crystal panel.

Figure 6:
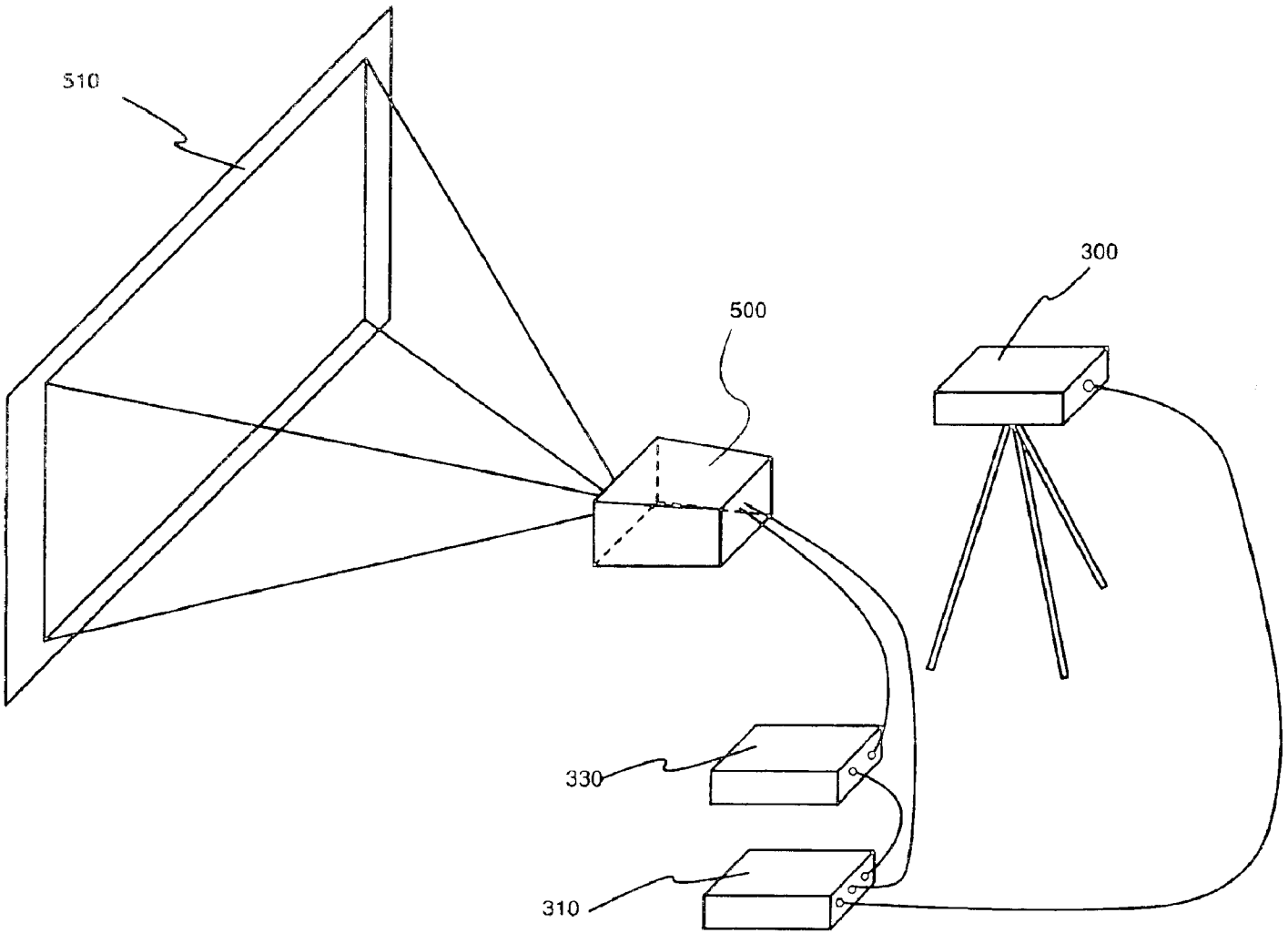
FIG. 6 is a diagram showing an arrangement for creating a correction table of a display device according to the present invention.

FIG. 6 is a diagram showing the arrangement of the respective devices for creating the correction table in the case of using the display device of the present invention as a front projector.

Figure 13:
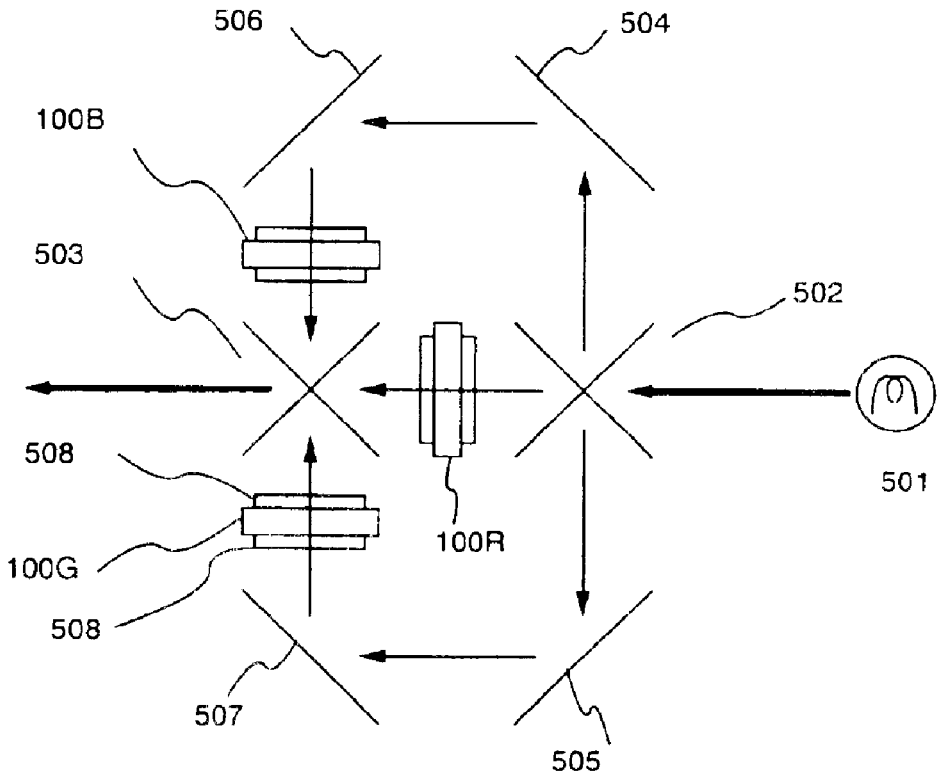
FIG. 13 is a structural diagram schematically showing an optical engine having incorporated therein a display device of the present invention.

Referring to FIG. 13, the structure of an optical engine 500 in FIG. 6 will be described. The optical engine 500 is comprised of a light source 501, cross dichroic mirrors 502, 503, mirrors 504, 505, 506, 507, and liquid crystal panels 100R, 100G, 100B. Each of the liquid crystal panels 100R, 100G, 100B is sandwiched between a pair of polarizing plates 508. The arrangement of the liquid crystal panels 100R, 100G, 100B is not limited thereto.

The light source 501 is a white light source. A metal halide lamp, for example, may be used as the light source 501. The cross dichroic mirror 502 splits white light emitted from the light source 501 into three beams of light having different colors from one another (red, blue, green). The mirrors 504 to 507 are total reflection mirrors. The liquid crystal panels 100R, 100G, 100B are for displaying images of red, green and blue, respectively. Red light, green light, and blue light are entered into the liquid crystal panels 100R, 100G, 100B, respectively, and optically modulated to become light containing image information Three beams of light which exit from the liquid crystal panels 100R, 100G, 100B and which contain image information are synthesized by the cross dichroic mirror 503. The light synthesized by the cross dichroic mirror 503 and containing image information is magnified through a lens or the like (not shown) and projected onto a screen (not shown).

Returning to FIG. 6, a description is given on a case where the optical engine with the display device of the present invention incorporated therein is used as a front projector. As shown in FIG. 6, the correction table is created using the optical engine 500, a screen 510, the signal generator 330, the digital signal processor 310, and the image picking device 300. The image picking device 300 picks up an image displayed on the screen, and converts the image into a digital signal. The process of creating the correction table is as described above.

Figure 7:
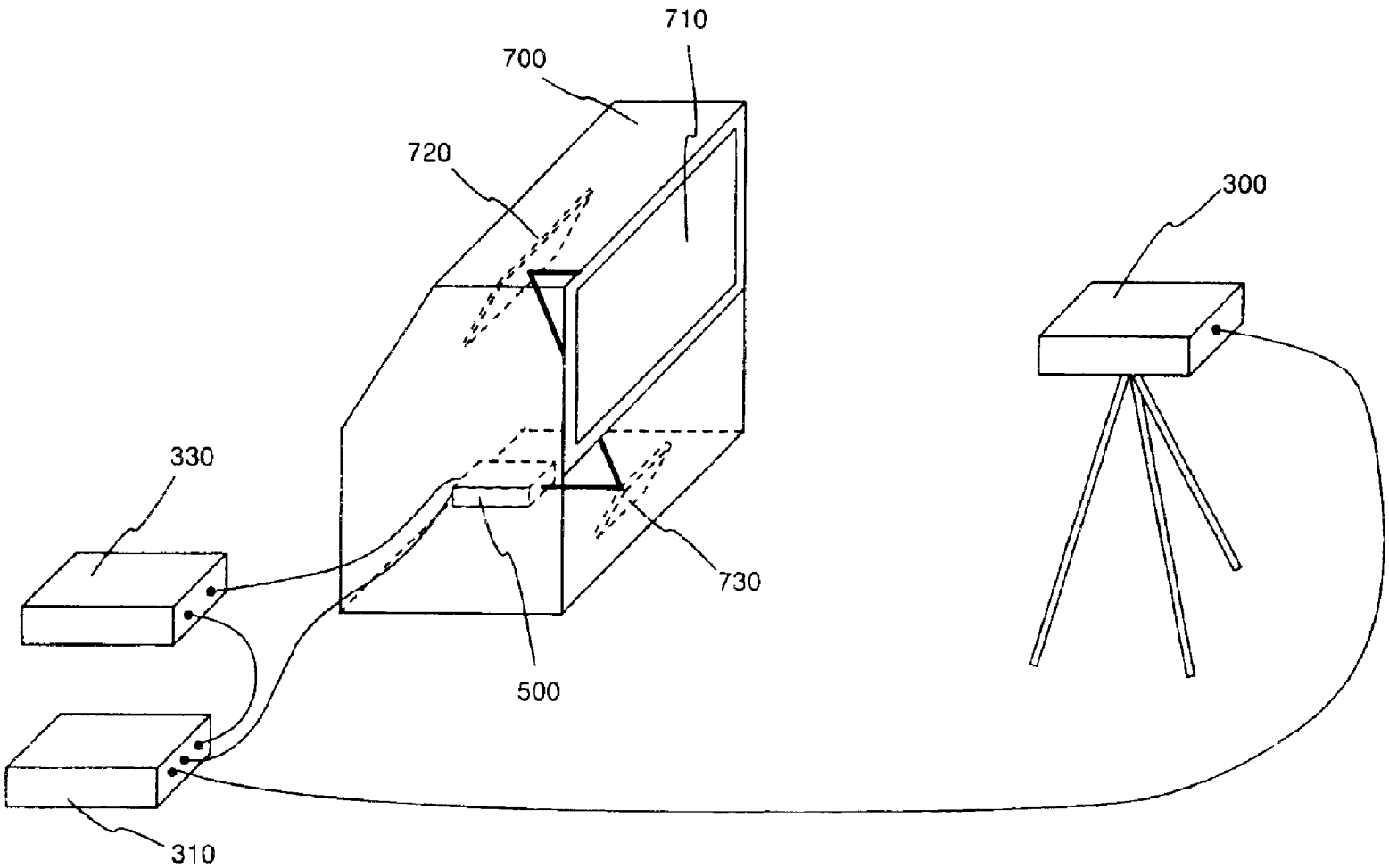
FIG. 7 is a diagram showing an arrangement for creating a correction table of a display device according to the present invention.

FIG. 7 shows the arrangement for creating the correction table in the case where the optical engine with the display device of the present invention incorporated therein is used as a rear projector.

Reference numeral 700 denotes a main body of the rear projector, 710, a screen, and 720, 730, reflectors. The optical engine 500 similar to the one shown in FIG. 13 is used here.

Note that 8 bit digital data is taken as an example in this embodiment mode but the invention is not limited thereto, and that n bit digital data may be processed instead (n is any natural number).

The description given here in this embodiment mode is about the case where an analog video signal is input from the external. However, a digital video signal may be input from the external. The A/D conversion circuit of the image processing circuit 160 is not necessary in that case.

Hereinafter embodiments of a display device according to the present invention will be described.

[Embodiment 1]

This embodiment gives a description with reference to FIGS. 8A to 12 on an example of a process of manufacturing a liquid crystal panel for a display device of the present invention. In the liquid crystal panel in this embodiment, a pixel portion, a source driver, a gate driver, etc. are integrally formed on a single substrate. For conveniences' sake in explanation, let us assume that a pixel TFT, an N-channel TFT for forming an analog switch of a D/A conversion circuit, and a P-channel TFT and an N-channel TFT for forming an inverter circuit are formed on the same substrate in the drawings.

Figure 8A:
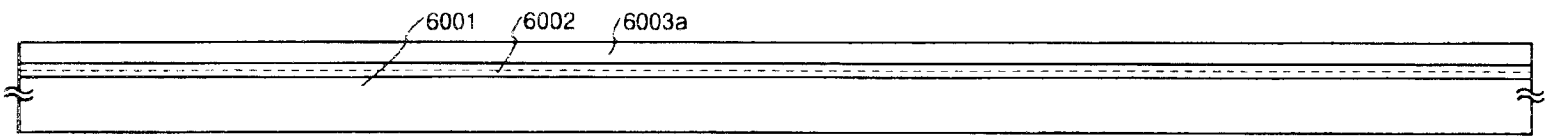
FIGS. 8A to 8D are diagrams showing a process of manufacturing a liquid crystal panel in an embodiment of a display device according to the present invention.

In FIG. 8A, a low-alkaline glass substrate or a quartz substrate can be used as a substrate 6001. In this embodiment, a low-alkaline glass substrate was used. In this case, a heat treatment at a temperature lower by about 10 to 20° C. than the strain point of glass may be performed in advance. On the surface of this substrate 6001 on which TFrs are to be formed, a base film 6002 such as a silicon oxide film, a silicon nitride film or a silicon oxynitride film is formed in order to prevent the diffusion of impurities from the substrate 6001. For example, a laminate is formed from: a silicon oxynitride film which is fabricated from $SiH_4$, $NH_3$, $N_2O$ by plasma CVD into 100 nm thickness; and a silicon oxynitride film which is similarly fabricated from $SiH_4$ and $N_2O$ into 200 nm.

Next, a semiconductor film 6003*a* that has an amorphous structure and a thickness of 20 to 150 nm (preferably, 30 to 80 nm) is formed by a known method such as plasma CVD or sputtering. In this embodiment, an amorphous silicon film was formed to a thickness of 54 nm by plasma CVD. As semiconductor films which have an amorphous structure, there are an amorphous semiconductor film and a microcrystalline semiconductor, film; and a compound semiconductor film with an amorphous structure such as an amorphous silicon germanium film may also be applied. Further, the base film 6002 and the amorphous silicon film 6003*a* can be formed by the same deposition method, so that the two films can be formed in succession. By not exposing the base film to the atmospheric air after the formation of the base film, the surface of the base film can be prevented from being contaminated, as a result of which the dispersion in characteristics of the fabricated TFTs and the variation in the threshold voltage thereof can be reduced. (FIG. 8A)

Figure 8B:
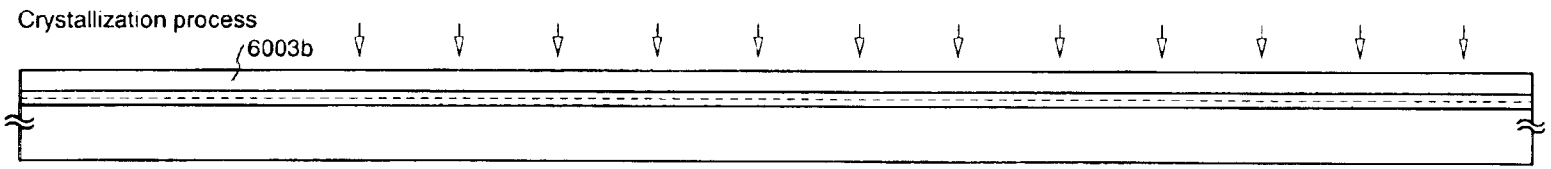
Figure 8C:
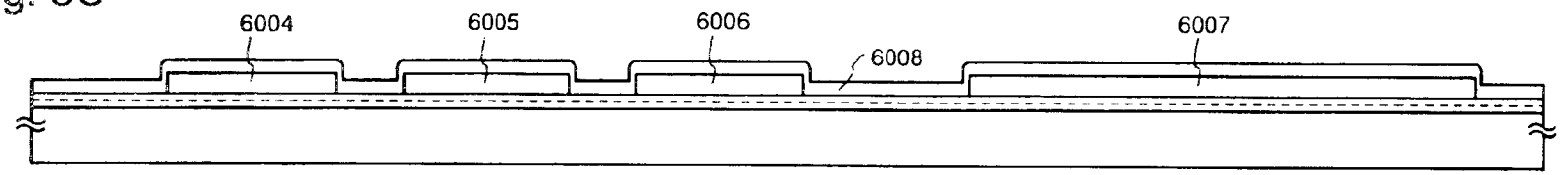

Then, by a known crystallization technique, a crystalline silicon film 6003*b* is formed from the amorphous silicon film 6003*a*. For example, a laser crystallization method or a thermal crystallization method (solid phase growth method) may be applied. Here, in accordance with the technique disclosed in Japanese Patent Application Laid-open No. Hei 7-130652, the crystalline silicon film 6003*b* was formed by the crystallization method using a catalytic element. It is preferred that, prior to the crystallization step, heat treatment is carried out at 400 to 500° C. for about one hour though it depends on the amount of hydrogen contained, so that, after the amount of hydrogen contained is reduced to 5 atomic % or less, the crystallization is carried out. The atoms are subjected to re-configuration to become dense when an amorphous silicon film is crystallized; and therefore, the thickness of the crystalline silicon film fabricated is reduced by about 1 to 15% than the initial thickness of the amorphous silicon film (54 nm in this embodiment). (FIG. 8B)

Then, the crystalline silicon film 6003*b* is patterned into islands, whereby island semiconductor layers 6004 to 6007 are formed. Thereafter, a mask layer 6008 of a silicon oxide film is formed to a thickness of 50 to 150 nm by plasma CVD or sputtering. (FIG. 8C) In this Embodiment the thickness of the mask layer 6008 is set at 130 nm.

Then, a resist mask 6009 is provided, and, into the entire surfaces of the island semiconductor layers 6004 to 6007 forming the N-channel type TFTs, boron (B) was added as an impurity element imparting p-type conductivity, at a concentration of about $1\times10^{16}$ to $15\times10^{17}$ atoms/cm$^3$. The addition of boron (B) here is performed for the purpose of threshold voltage control. The addition of boron (B) may be effected either by ion doping or it may be added simultaneously when the amorphous silicon film is formed. The addition of boron (B) here was not always necessary. (FIG. 8D)

In order to form the LDD regions of the N-channel TFTs in the driving circuit such as the driver, an impurity element imparting n-type conductivity is selectively added to the island semiconductor layers 6010 to 6012. For this purpose, resist masks 6013 to 6016 were formed in advance. As the impurity element imparting the n-type conductivity, phosphorus (P) or arsenic (As) may be used; here, in order to add phosphorus (P), ion doping using phosphine ($PH_3$) was applied. The concentration of phosphorus (P) in the impurity regions 6017 and 6018 thus formed may be set within the range of from $2\times10^{16}$ to $5\times10^{19}$ atoms/cm$^3$. In this specification, the concentration of the impurity element contained in the thus formed impurity regions 6017 to 6019 imparting n-type conductivity is represented by (n). Further, the impurity region 6019 is a semiconductor layer for forming the storage capacitor of the pixel section; into this region, phosphorus (P) was also added in the same concentration. (FIG. 9A) Thereafter, resist masks 6013 to 6016 are removed.

Figure 8D:
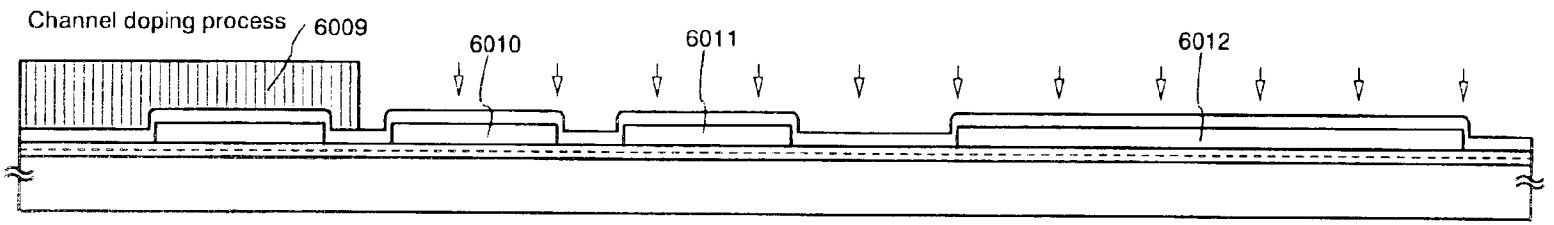
Figures 9A, 9B, 9C, 9D:
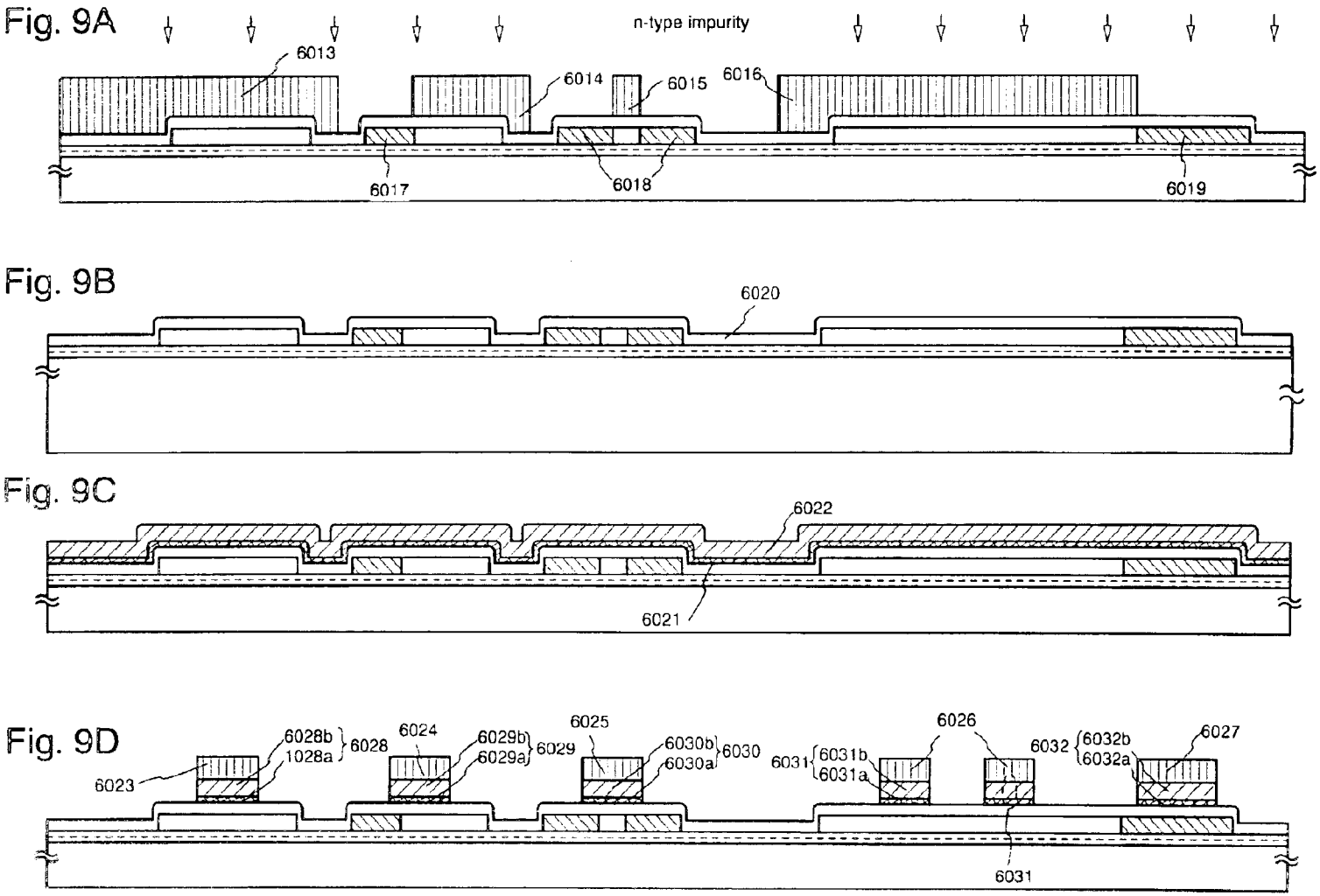
FIGS. 9A to 9D are diagrams showing the process of manufacturing the liquid crystal panel in the embodiment of a display device according to the present invention.

Next, the mask layer 6008 is removed by hydrofluoric acid or the like, and the step of activating the impurity elements added in the steps shown in FIGS. 8D and 9A is carried out. The activation can be carried out by performing heat treatment in a nitrogen atmosphere at 500 to 600° C. for 1 to 4 hours or by using the laser activation method. Further, both methods may be jointly performed. In this embodiment, the laser activation method was employed, and a KrF excimer laser beam (with a wavelength of 248 nm) was used. In this embodiment the shape of the laser light is formed into a linear beam, and the entire surface of the substrate on which island semiconductor layers are formed is scanned under the condition that the oscillation frequency was 5 to 50 Hz, the energy density was 100 to 500 mJ/cm$^2$, and the overlap ratio of the linear beam was 80 to 98%. Note that there is no item of the laser light irradiation condition that is subjected to limitation, and they can be appropriately determined.

Then, a gate insulating film 6020 is formed from an insulating film comprising silicon to a thickness of 10 to 150 nm, by plasma CVD or sputtering. For example, a silicon oxynitride film is formed to a thickness of 120 nm. As the gate insulating film, another insulating film comprising silicon may be used as a single layer or a laminate structure. (FIG. 9B)

Next, in order to form a gate electrode, a first conductive layer is deposited. This first conductive layer may be comprised of a single layer but may also be comprised of a laminate consisting of two or three layers. In this embodiment, a conductive layer (A) 6021 comprising a conductive metal nitride film and a conductive layer (B) 6022 comprising a metal film are laminated. The conductive layer (B) 6022 may be formed of an element selected from among tantalum (Ta), titanium (Ti), molybdenum (Mo) and tungsten (W) or an alloy comprised mainly of the above-mentioned element, or an alloy film (typically, an Mo—W alloy film or an Mo—Ta alloy film) comprised of a combination of the above-mentioned elements, while the conductive layer (A) 6021 comprises tantalum nitride (TaN), tungsten nitride (WN), titanium nitride (TiN), or molybdenum nitride (MoN). Further, as the substitute materials of the conductive film (A) 6021, tungsten silicide, titanium silicide, and molybdenum silicide may also be applied. The conductive layer (B) 6022 may preferably have its impurity concentration reduced in order to decrease the resistance thereof; in particular, as for the oxygen concentration, the concentration may be set to 30 ppm or less. For example, tungsten (W) could result in realizing a resistivity of 20 $\mu\Omega$cm or less by rendering the oxygen concentration thereof to 30 ppm or less.

The conductive layer (A) 6021 may be set to 10 to 50 nm (preferably, 20 to 30 nm), and the conductive layer (B) 6022 may be set to 200 to 400 nm (preferably, 250 to 350 nm). In this embodiment, as the conductive layer (A) 6021, a tantalum nitride film with a thickness of 50 nm was used, while, as the conductive layer (B) 6022, a Ta film with a thickness of 350 nm was used, both films being formed by sputtering. In case of performing sputtering here, if a suitable amount of Xe or Kr is added into the sputtering gas Ar, the internal stress of the film formed is alleviated, whereby the film can be prevented from peeling off. Though not shown, it is effective to form a silicon film, into which phosphorus (P) is doped, to a thickness of about 2 to 20 nm underneath the conductive layer (A) 6021. By doing so, the adhesiveness of the conductive film formed thereon can be enhanced, and at the same time, oxidation can be prevented. In addition, the alkali metal element slightly contained in the conductive film (A) or the conductive film (B) can be prevented from diffusing into the gate insulating film 6020. (FIG. 9C)

Next, resist masks 6023 to 6027 are formed, and the conductive layer (A) 6021 and the conductive layer (B) 6022 are etched together to form gate electrodes 6028 to 6031 and a capacitor wiring 6032. The gate electrodes 6028 to 6031 and the capacitor wiring 6032 are formed in such a manner that the layers 6028*a* to 6032*a* comprised of the conductive layer (A) and the layers 6028*b* to 6032*b* comprised of the conductive layer (B) are formed as one body respectively. In this case, the gate electrodes 6028 to 6030 formed in the driving circuit are formed so as to overlap the portions of the impurity regions 6017 and 6018 through the gate insulating film 6020. (FIG. 9D)

Figure 10A:
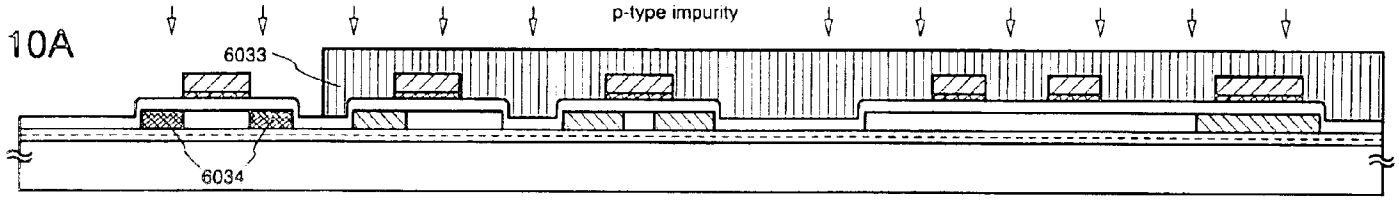
FIGS. 10A to 10D are diagrams showing the process of manufacturing the liquid crystal panel in the embodiment of a display device according to the present invention.

Then, in order to form the source region and the drain region of the P-channel TFT in the driving circuit, the step of adding an impurity element imparting p-type conductivity is carried out. Here, by using the gate electrode 6028 as a mask, impurity regions are formed in a self-alignment manner. In this case, the region in which the N-channel TFT will be formed is covered with a resist mask 6033 in advance. Thus, impurity regions 6034 were formed by ion doping using diborane ($B_2H_6$). The concentration of boron (B) in this region is brought to $3\times10^{20}$ to $3\times10^{21}$ atoms/cm$^3$. In this specification, the concentration of the impurity element imparting p-type contained in the impurity regions 6034 is represented by ($p^{++}$). (FIG. 10A)

Figure 10B:
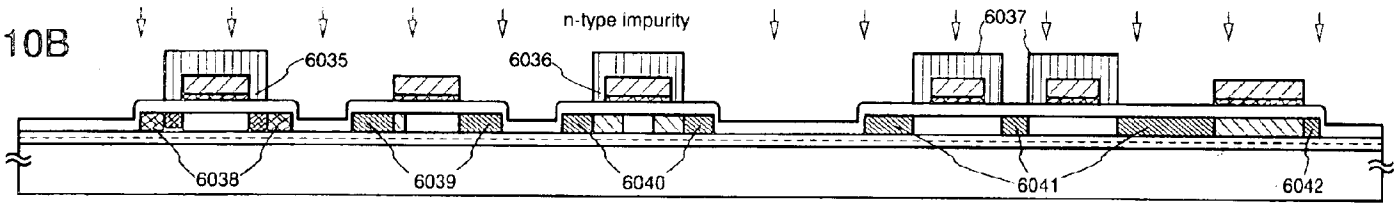

Next, in the N-channel TFTs, impurity regions that functioned as source regions or drain regions were formed. Resist masks 6035 to 6037 were formed, and an impurity element for imparting the n-type conductivity was added to form impurity regions 6038 to 6042. This was carried out by ion doping using phosphine ($PH_3$), and the phosphorus (P) concentration in these regions was set to $1\times10^{20}$ to $1\times10^{21}$ atoms/cm$^3$. In this specification, the concentration of the impurity element imparting the n-type contained in the impurity regions 6038 to 6042 formed here is represented by ($n^+$). (FIG. 10B)

In the impurity regions 6038 to 6042, the phosphorus (P) or boron (B) that are added in the preceding steps are contained, however, as compared with this impurity element concentration, phosphorus is added here at a sufficiently high concentration, so that the influence by the phosphorus (P) or boron (B) added in the preceding steps need not be taken into consideration. Further, the concentration of the phosphorus (P) that is added into the impurity regions 6038 is ½ to ⅓ of the concentration of the boron (B) added in the step shown in FIG. 10A, and thus, the p-type conductivity was secured, and no influence was exerted on the characteristics of the TFTs.

Figure 10C:
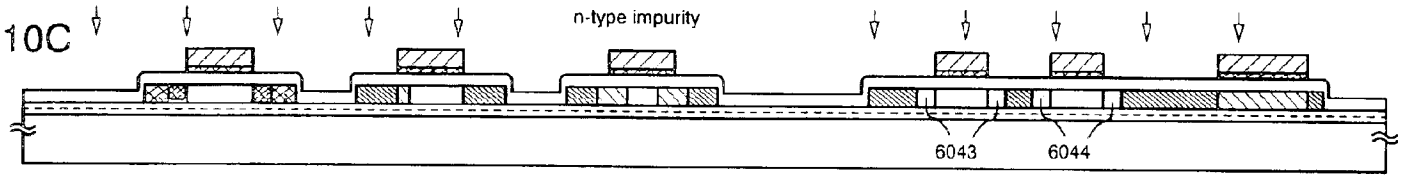

Then, the step of adding an impurity imparting n-type for formation of the LDD regions of the N-channel TFT in the pixel section was carried out. Here, by using the gate electrode 6031 as a mask, the impurity element for imparting n-type was added in a self-alignment manner. The concentration of phosphorus (P) added was $1\times10^{16}$ to $5\times10^{18}$ atoms/cm$^3$; by thus adding phosphorus at a concentration lower than the concentrations of the impurity elements added in the steps shown in FIGS. 9A, 10A and 10B, only impurity regions 6043 and 6044 are substantially formed. In this specification, the concentration of the impurity element imparting the n-type contained in these impurity regions 6043 and 6044 is represented by ($n^-$). (FIG. 10C)

Here, a film such as SiON film or the like may be formed into 200 nm thickness as an interlayer film for preventing peeling of gate electrode Ta.

Thereafter, in order to activate the impurity elements, which were added at their respective concentrations for imparting n-type or p-type, a heat treatment step is carried out. This step can be carried out by furnace annealing, laser annealing or rapid thermal annealing (RTA). Here, the activation step was performed by furnace annealing. Heat treatment is carried out in a nitrogen atmosphere with an oxygen concentration of 1 ppm or less, preferably 0.1 ppm or less, at 400 to 800° C., generally at 500 to 600° C.; in this embodiment, the heat treatment was carried out at 500° C. for 4 hours. Further, in case a substrate such as a quartz substrate which has heat resistance is used as the substrate 6001, the heat treatment may be carried out at 800° C. for one hour; in this case, the activation of the impurity elements and the formation of junctions between the impurity regions into which the impurity element was added and the channel-forming region could be performed well. Note that in case that the above stated interlayer film for preventing peeling of gate electrode Ta is formed, there are cases that such effect cannot be obtained. By this beat treatment, on the metal films 6028*b* to 6032*b*, which form the gate electrodes 6028 to 6031 and the capacitor wiring 6032, conductive layers (C) 6028*c* to 6032*c* are formed with a thickness of 5 to 80 nm as measured from the surface. For example, in the case the conductive layers (B) 6028*b* to 6032*b* are made of tungsten (W), tungsten nitride (WN) is formed; in the case of tantalum (Ta), tantalum nitride (TaN) can be formed. Further, the conductive layers (C) 6028*c* to 6032*c* can be similarly formed by exposing the gate electrodes 6028 to 6031 and the capacitor wiring 6032 to a plasma atmosphere containing nitrogen which plasma atmosphere uses nitrogen or ammonia. Further, heat treatment was carried out in an atmosphere containing 3 to 100% of hydrogen at 300 to 450° C. for 1 to 12 hours, thus performing the step of hydrogenating the island semiconductor layers. This step is a step for terminating the dangling bonds of the semiconductor layers by the thermally excited hydrogen. As another means for the hydrogenation, plasma hydrogenation (using the hydrogen excited by plasma) may be performed.

Figure 10D:
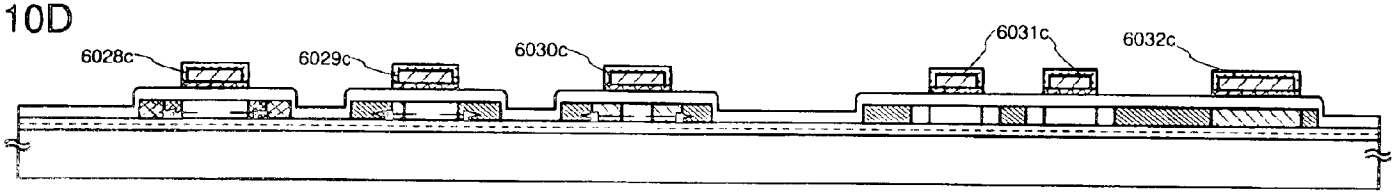

In the case the island semiconductor layers were fabricated by the crystallization method using a catalytic element from an amorphous silicon film, a trace amount of the catalytic element remained in the island semiconductor layers. Of course, it is possible to complete the TFT even in such a state however, it was more preferable to remove the residual catalytic element at least from the channel-forming region. As one of the means for removing this catalytic element, there is the means utilizing the gettering function of phosphorus (P). The concentration of phosphorus (P) necessary to perform gettering is at the same level as that of the impurity region ($n^+$) which was formed in the step shown in FIG. 10B; by the heat treatment at the activation step carried out here, the catalytic element could be gettered from the channel-forming region of the N-channel and the P-channel TFTs. (FIG. 10D)

A first interlayer insulating film 6045 is formed of a silicon oxide film or a silicon oxynitride film with a thickness of 500 to 1500 nm, and contact holes reaching the source regions or the drain regions, which are formed in the respective island semiconductor layers, are formed; and source wirings 6046 to 6049 and drain wirings 6050 to 6053 are formed. (FIG. 11A) Though not shown, in this embodiment, these electrodes were formed from a three-layer structure which was constituted by continuously forming a Ti film with a thickness of 100 nm, an aluminum film containing Ti and having a thickness of 500 nm, and a Ti film with a thickness of 150 nm by sputtering.

Figure 11A:
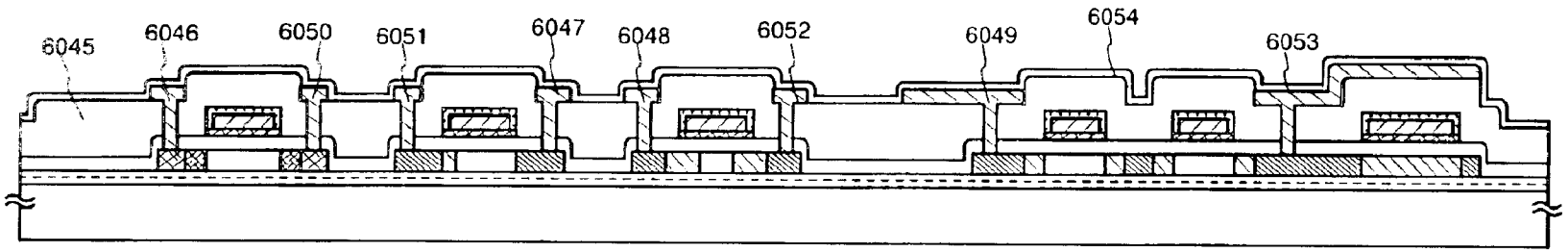
FIGS. 11A and 11B are diagrams showing the process of manufacturing the liquid crystal panel in the embodiment of a display device according to the present invention.

Next, as a passivation film 6054, a silicon nitride film, a silicon oxide film or a silicon oxynitride film is formed to a thickness of 50 to 500 nm (typically, 100 to 300 nm). In this Embodiment the passivation film 6054 is made into a laminate film of a 50 nm thick silicon nitride film and a 24.5 nm silicon oxide film. In the case that a hydrogenating treatment is carried out in this state, a desirable result was obtained in respect of the enhancement in characteristics of the TFTs. For example, it is preferable to carry out heat treatment in an atmosphere containing 3 to 100% of hydrogen at 300 to 450° C. for 1 to 12 hours; or, in the case that the plasma hydrogenation method was employed, a similar effect was obtained. Here, openings may be formed in the passivation film 6054 at the positions at which contact holes for connecting the pixel electrodes and drain wirings to each other will be formed later. (FIG. 11A)

Figure 11B:
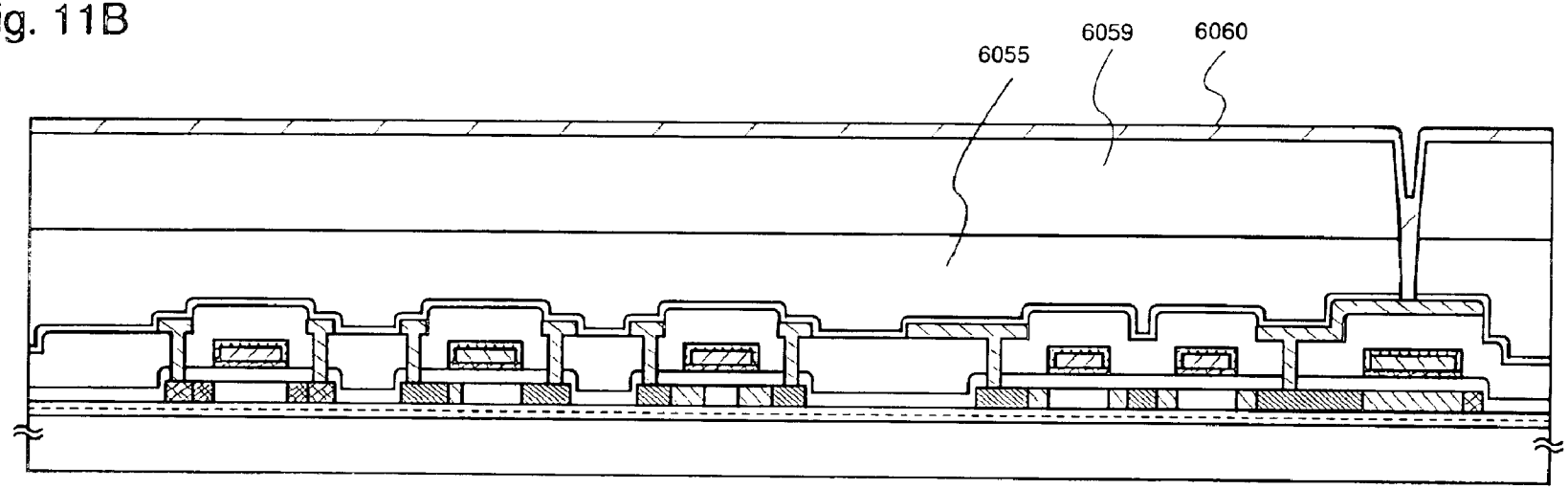

Thereafter, a second interlayer insulating film 6055 comprised of an organic resin is formed to a thickness of 1.0 to 1.5 $\mu$m. As the organic resin, polyimide, acrylic, polyamide, polyimideamide, BCB (benzocyclobutene), etc., can be used. Here, acrylic of the type that, after applied to the substrate, thermally polymerizes was used; it was fired at 250° C., whereby the second interlayer dielectric film was formed. (FIG. 11B)

A capacitor for a D/A converter circuit is then formed here. An electrode which should function as the electrode of the capacitor of the D/A converter circuit is formed on the same wiring layer as the drain wiring. All of the second interlayer insulating film 6055 is removed in the areas above the said electrode. (Not shown) A black matrix is then formed. (Not shown) In this embodiment the black matrix is a laminate structure formed from a Ti film of 100 nm and an alloy film of Al and Ti into 300 nm. Accordingly a capacitor of the D/A converter circuit is formed in this embodiment between the electrode and the black matrix.

Thereafter a third interlayer insulating film 6059 is formed from an organic resin into 1.0 to 1.5 mm. As the organic resin, similar resins as the second interlayer insulating film may be used. Here a polyimide of a type that thermally polymerizes after application to the substrate is used and the film is formed by firing at 300° C.

Then, a contact hole reaching the drain wiring 6053 was formed in the second interlayer insulating film 6055, and the third interlayer insulating film 6059 is formed, and a pixel electrode 6060 is formed. In forming a transmission type liquid crystal panel of the present invention, a transparent conductive film of ITO or the like is used as the pixel electrode 6060. (FIG. 11B)

In this way, a substrate having the TFTs of the driving circuit and the pixel TFTs of the pixel section on the same substrate can be completed. In the driving circuit, there are formed a P-channel TFT 6101, a first N-channel TFT 6102 and a second N-channel TFT 6103, while, in the pixel portion, there are formed a pixel TFT 6104 and a storage capacitor 6105. (FIG. 12) In this specification, such a substrate is called active matrix substrate for convenience.

Next the processes for forming a transmission type liquid crystal panel from an active matrix substrate manufactured through the above processes is described.

Figure 12:
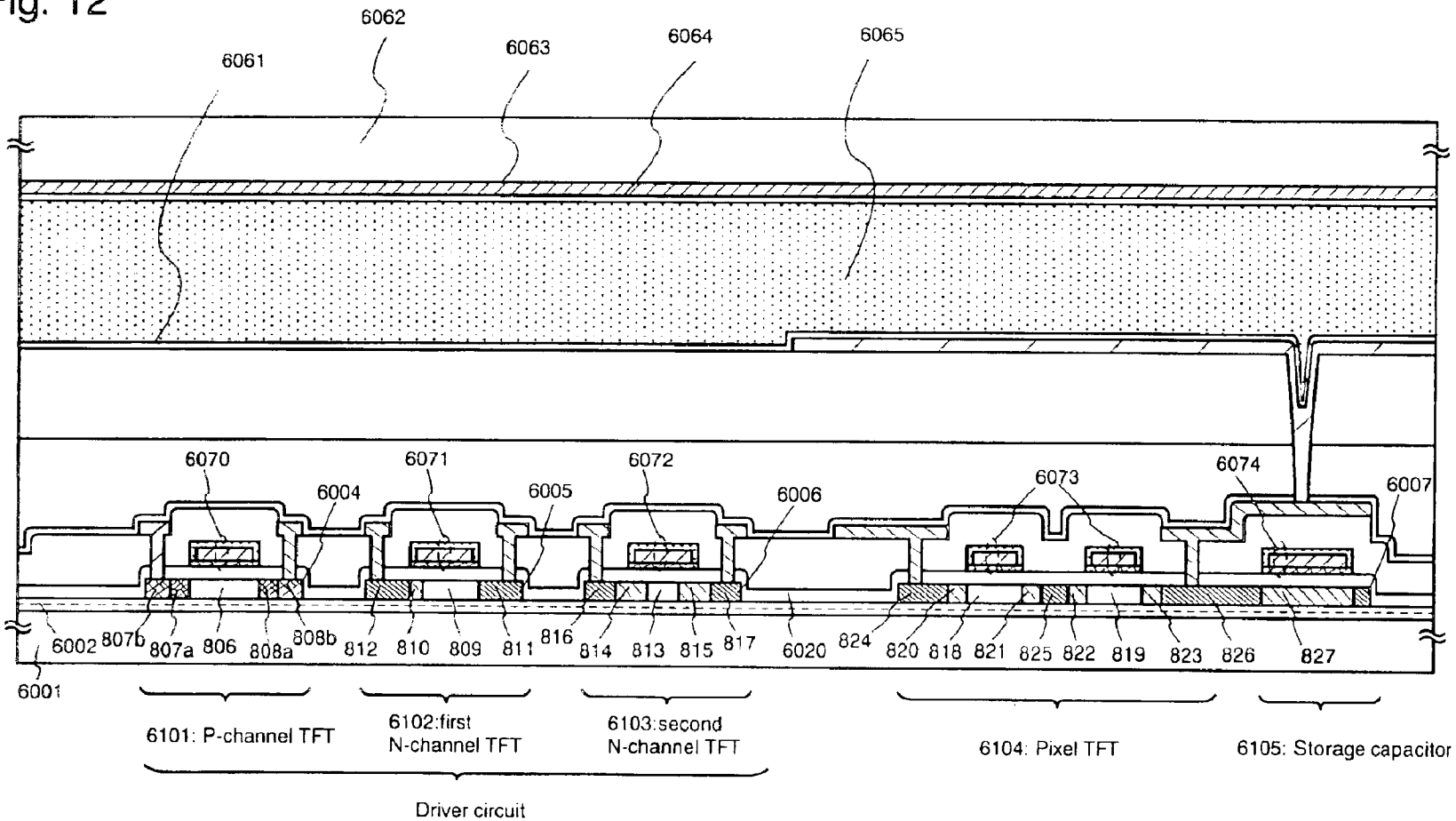
FIG. 12 is a diagram showing the process of manufacturing the liquid crystal panel in the embodiment of a display device according to the present invention.

An alignment film 6061 is formed on the active matrix substrate of the state of FIG. 12. Polyimide is used as the alignment film in the present embodiment. An opposing substrate is next prepared. The opposing substrate comprises a glass substrate 6062, an opposing electrode 6063 comprising a transparent conductive film and an alignment film 6064.

Note that in the present embodiment a polyimide film of the type in which liquid crystal molecules are oriented in parallel with respect to the substrate is used as the alignment film. By performing rubbing treatment after forming the alignment film, liquid crystal molecules are made to orient in parallel with a prescribed pre-tilt angle.

Next the active matrix substrate which went through the above processes and the opposing substrate are stuck together through a sealant, spacers (neither shown) or the like by a known cell assembly process. Thereafter liquid crystal 6065 is injected between the both substrates and completely sealed with a sealant (not shown). A transmission type liquid crystal panel as shown in FIG. 12 is thus completed.

Note that in the present embodiment the transmission type liquid crystal panel is made to perform display by a TN (twist) mode. Therefore the a polarizing plate (not shown) is disposed on the transmission type liquid crystal panel.

The P-channel TFr 6101 in the driving circuit has a channel-forming region 806, source regions 807*a* and 807*b* and drain regions 808*a* and 808*b* in the island semiconductor layer 6004. The first N-channel TFT 6102 has a channel-forming region 809, a gate electrode 6070, an LDD region 810 overlapping the gate electrode 6071 (such an LDD region will hereinafter be referred to as Lov), a source region 811 and a drain region 812 in the island semiconductor layer 6005. The length in the channel direction of this Lov region is set to 0.5 to 3.0 μm, preferably 1.0 to 1.5 μm. A second N-channel TFF 6103 has a channel-forming region 813, LDD regions 814 and 815, a source region 816 and a drain region 817 in the island semiconductor layer 6006. In these LDD regions, there are formed an Lov region and an LDD region which does not overlap the gate electrode 6072(such an LDD region will hereafter be referred as Loff); and the length in the channel direction of this Loff region is 0.3 to 2.0 μm, preferably 0.5 to 1.5 μm. The pixel TFT 6104 has channel-forming regions 818 and 819, Loff regions 820 to 823, and source or drain regions 824 to 826 in the island semiconductor layer 6007. The length in the channel direction of the Loff regions is 0.5 to 3.0 μm, preferably 1.5 to 2.5 μm. In addition, offset regions (not shown) are formed between the channel forming regions 818 and 819 of the pixel TFT 6104 and Loff regions 820 to 823 that are LDD regions of the pixel TFT. Further, the storage capacitor 6105 comprises capacitor wiring 6074, an insulating film composed of the same material as the gate insulating film 6020 and a semiconductor layer 827 which is connected to the drain region 826 of the pixel TFT 6073 and in which an impurity element for imparting the n conductivity type is added. In FIG. 12, the pixel TFT 6104 is of the double gate structure, but may be of the single gate structure, or may be of a multi-gate structure in which a plurality of gate electrodes are provided.

As described above the TFT structures that constitute each circuit are optimized in accordance with the specifications required by the pixel TFT and the driver, and it is possible to improve the operation performance and reliability of the liquid crystal panel.

A transmission type liquid crystal panel is described in this embodiment. However, liquid crystal panels to which the digital driver of the present invention is applicable are not limited to this type, and the present invention may be applied also to a reflection type liquid crystal panel.

[Embodiment 2]

Shown in this embodiment is an example in which a liquid crystal panel of a display device according to the present invention is composed of a reverse stagger type TFT.

Figure 14A:
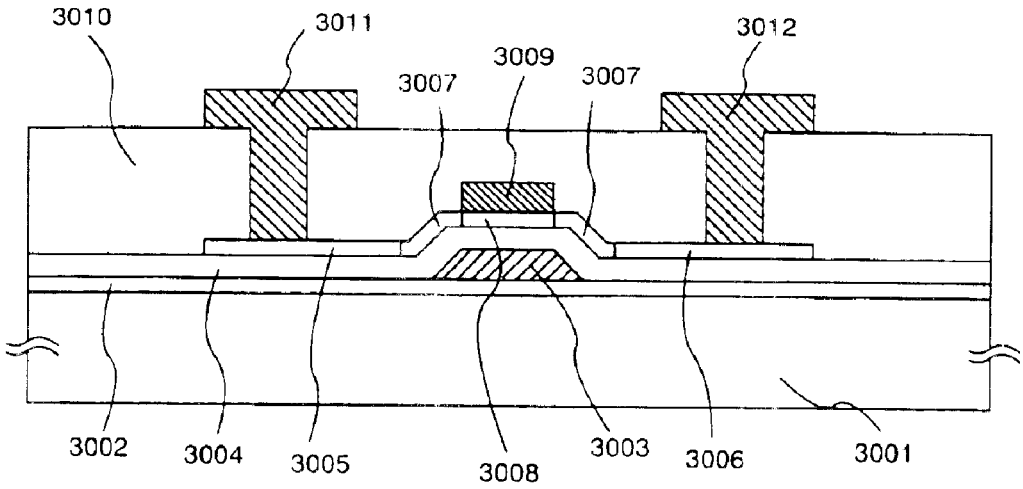
FIGS. 14A and 14B are sectional views each showing a liquid crystal panel in an embodiment of a display device according to the present invention.
Figure 14B:
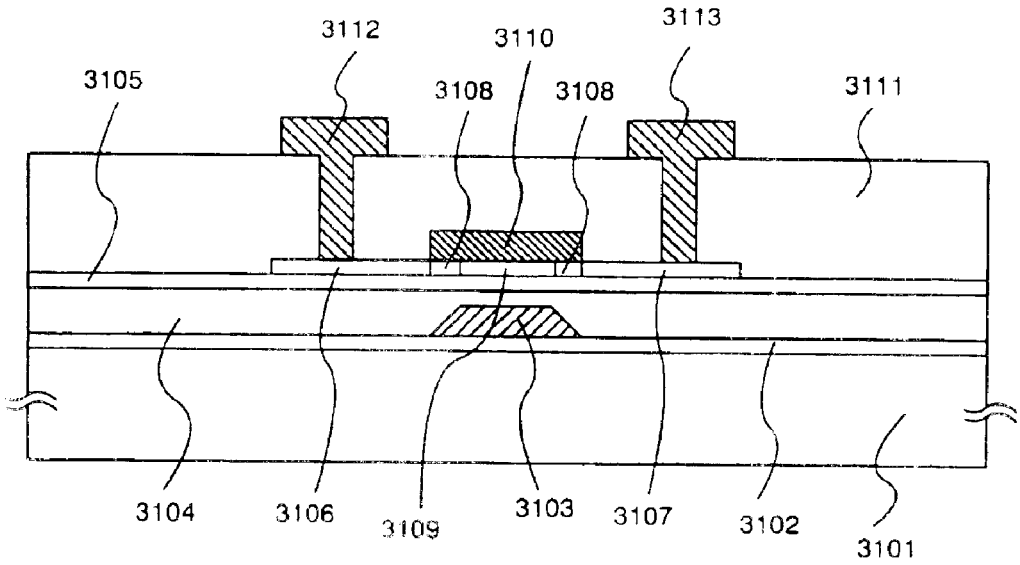

Reference is made to FIGS. 14A and 14B which are sectional views of reverse stagger type N-channel TFTs for forming the liquid crystal panel of this embodiment. Needless to say, both P-channel TFT and N-channel TFT are used to form a CMOS circuit, although merely one N-channel TFT is shown in FIGS. 14A and 14B. Also it goes without saying that a pixel TFT may be formed in a similar way.

Referring to FIG. 14A, denoted by 3001 is a substrate, a material of which is chosen from ones mentioned in Embodiment 1. Reference numeral 3002 denotes a silicon oxide film, 3003, a gate electrode, and 3004, a gate insulating film. Denoted by 3005, 3006, 3007, 3008 are active layers made of a polycrystalline silicon film. To form these active layers, the same method by which an amorphous silicon film is crystallized into a polycrystalline silicon film, described in Embodiment 1, is used. Alternatively, the amorphous silicon film may be crystallized by laser light (preferably, linear laser light or sheet-like laser light). Specifically, denoted by 3005 is a source region, 3006, a drain region, 3007, low concentration impurity regions (LDD regions), and 3008, a channel formation region. Reference numeral 3009 denotes a channel protecting film, 3010, an interlayer insulating film, 3011, a source electrode, and 3012, a drain electrode.

Referring next to FIG. 14B, a description will be given on a case where the liquid crystal panel is composed of a reverse stagger type TFT having a structure different from that of the TFT shown in FIG. 14A.

Also in FIG. 14B, merely one N-channel TFT is shown in the drawing. However, as described above, a CMOS circuit may of course be composed of both P-channel TFT and N-channel TFT. Also it goes without saying that a pixel TFT may be formed in a similar way.

Reference numeral 3101 denotes a substrate, 3102, a silicon oxide film, and 3103, a gate electrode. Denoted by 3104 is a benzocyclobutene (BCB) film, of which top surface is planarized. A silicon nitride film is denoted by 3105. The BCB film and the silicon nitride film together form a gate insulating film. Reference numerals 3106, 3107, 3108, 3109 denote active layers made of a polycrystalline silicon film. To form these active layers, the same method by which an amorphous silicon film is crystallized into a polycrystalline silicon film, described in Embodiment 1, is used. Alternatively, the amorphous silicon film may be crystallized by laser light (preferably, linear laser light or sheet-like laser light). Specifically, denoted by 3106 is a source region, 3107, a drain region, 3108, low concentration impurity regions (LDD regions), and 3109, a channel formation region. Reference numeral 3110 denotes a channel protecting film, 3111, an interlayer insulating film, 3112, a source electrode, and 3113, a drain electrode.

According to this embodiment, the gate insulating film consisting of the BCB film and the silicon nitride film are leveled so that the amorphous silicon film to be formed thereon is also planar. Therefore in crystallizing the amorphous silicon film into a polycrystalline silicon film, more uniform polycrystalline silicon film can be obtained as compared to conventional reverse stagger type TFTs.

[Embodiment 3]

It is possible to use a variety of liquid crystals other than nematic liquid crystals in a liquid crystal panel of the display device of the invention. For example, the liquid crystals disclosed in: Furue, H, et al., "Characteristics and Driving Scheme of Polymer-stabilized Monostable FLCD Exhibiting Fast Response Time and High Contrast Ratio with Gray-scale Capability," SID, 1998; in Yoshida, T., et al., "A Full-color Thresholdless Antiferroelectric LCD Exhibiting Wide Viewing Angle with Fast Response Time," SID 97 Digest, 841, 1997; S. Inui et al., "Thresholdless antiferroelectricity in Liquid Crystals and its Application to Displays", J. Mater. Chem. 6(4), 671–673, 1996; and in U.S. Pat. No. 5,594,569 can be used.

A liquid crystal that shows antiferroelectric phase in a certain temperature range is called an antiferroelectric liquid crystal. Among a mixed liquid crystal comprising antiferroelectric liquid crystal, there is one called thresholdless antiferroelectric mixed liquid crystal that shows electro-optical response characteristic in which transmissivity is continuously varied against electric field. Among the thresholdless antiferroelectric liquid crystals, there are some that show V-shaped electro-optical response characteristic, and even liquid crystals whose driving voltage is approximately ±2.5 V (cell thickness approximately 1 mm to 2 mm) are found.

Figure 15:
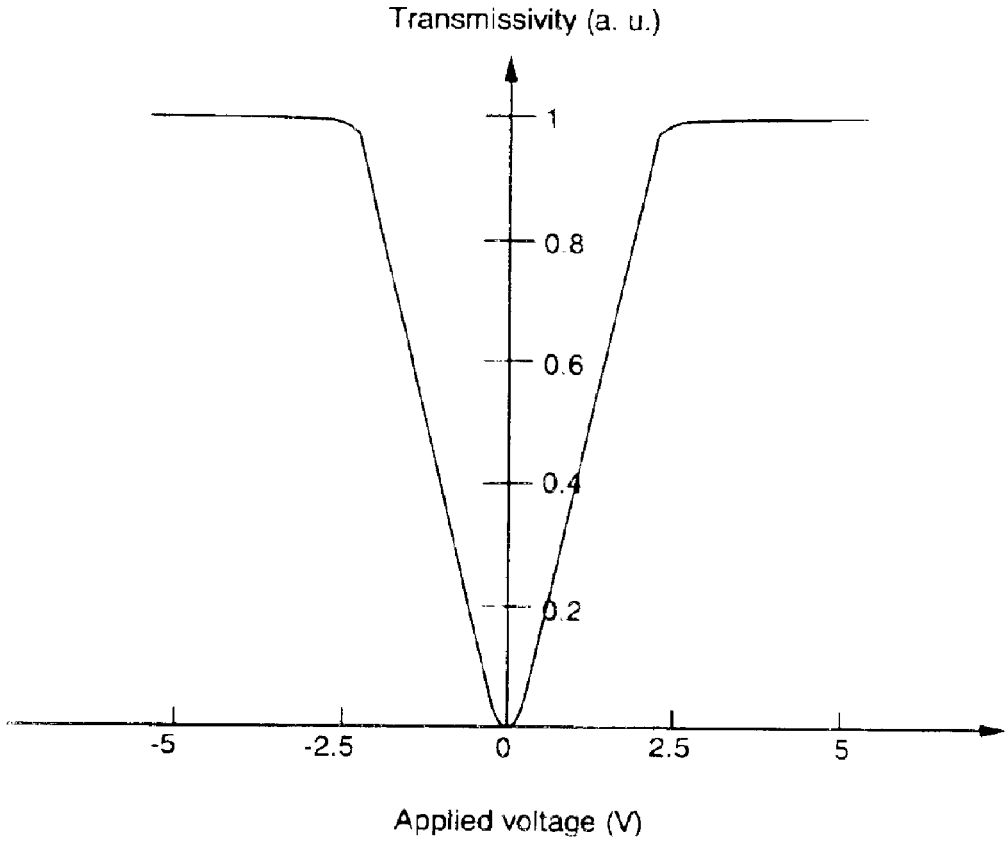
FIG. 15 is a graph showing an applied voltage-transmittance characteristic of antiferroelectric liquid crystal whose electro-optical characteristic graph forms a shape of letter V.

An example of light transmissivity characteristic against the applied voltage of thresholdless antiferroelectric mixed liquid crystal showing V-shaped electro-optical response characteristic, is shown in FIG. 15. The axis of ordinate in the graph shown in FIG. 15 is transmissivity (arbitrary unit) and the axis of the abscissas is the applied voltage. The transmitting direction of the polarizer on light incident side of the liquid crystal panel is set at approximately parallel to direction of a normal line of the smectic layer of thresholdless antiferroelectric liquid crystal that approximately coincides with the rubbing direction of the liquid crystal panel. Further, the transmitting direction of the polarizer on the light radiating side is set at approximately right angles (crossed Nicols) against the transmitting direction of the polarizer on the light incident side.

As shown in FIG. 15, it is shown that low voltage driving and gray scale display is available by using such thresholdless antiferroelectric mixed liquid crystal.

In the case of using the low voltage driving thresholdless antiferroelectric mixed liquid crystal to a liquid crystal panel having a digital driver, the operation power supply voltage of the D/A converter circuit can be lowered because the output voltage of the D/A converter circuit can be lowered, and the operation power voltage of the driver can be lowered. Accordingly, low consumption electricity and high reliability of the liquid crystal panel can be attained.

Therefore the use of such low voltage driving thresholdless antiferrelectric mixed liquid crystal is effective in case of using a TFT having a relatively small LDD region (low concentration impurity region) width (for instance 0 to 500 nm, or 0 to 200 nm).

Further, thresholdless antiferroelectric mixed liquid crystal has large spontaneous polarization in general, and the dielectric constant of the liquid crystal itself is large. Therefore, comparatively large storage capacitor is required in the pixel in case of using thresholdless antiferroelectric mixed liquid crystal for a liquid crystal panel. It is therefore preferable to use thresholdless antiferroelectric mixed liquid crystal having small spontaneous polarity.

A low consumption electricity of a liquid crystal panel is attained because low voltage driving is realized by the use of such thresholdless antiferroelectric mixed liquid crystal.

Further, any of liquid crystal display can be used as a display medium of the liquid crystal panels of the present invention on condition that the liquid crystal has an electro-optical characteristic shown in FIG. 15.

[Embodiment 4]

Display devices of the invention can be used by incorporating them into various electronic appliances.

Examples of the electronic appliances include a video camera, a digital camera, a projector (rear type or front type), a head mounted display (a goggle type display), a game machine, a car navigation system, a personal computer and a portable information terminal (a mobile computer, a cellular telephone, an electronic book, etc.). FIGS. 16A to 16F show examples of these.

Figure 16A:
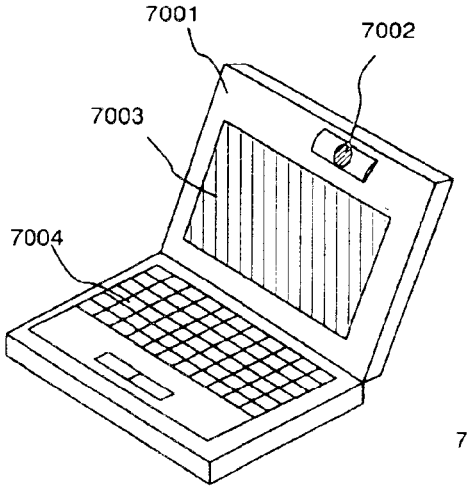
FIGS. 16A to 16F are diagrams showing examples of electronic equipment having incorporated therein one or more display devices of the present invention.

FIG. 16A shows a personal computer, which comprises: a main body 7001; an image input section 7002; a display device of the invention 7003; and a keyboard 7004.

Figure 16B:
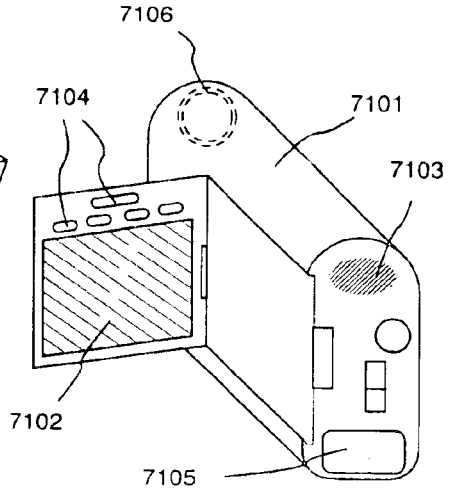

FIG. 16B shows a video camera, which comprises: a main body 7101; a display device of the invention 7102; a sound input section 7103; an operation switch 7104; a battery 7105; and an image receiving section 7106.

Figure 16C:
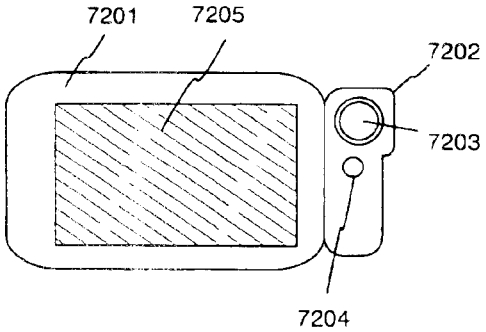

FIG. 16C shows a mobile computer, which comprises: a main body 7201; a camera section 7202; an image receiving section 7203; an operation switch 7204; and a display device of the invention 7205.

Figure 16D:
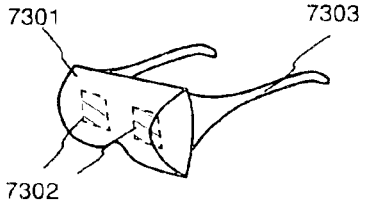

FIG. 16D shows a goggle type display, which comprises: a main body 7301; a display device of the invention 7302; and an arm section 7303.

Figure 16E:
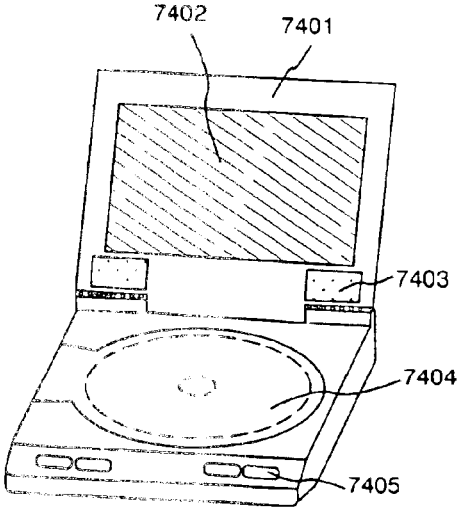

FIG. 16E shows a player that uses a recording medium storing a program (hereinafter called the "recording medium"). It comprises a main body 7401, a display device of the invention 7402, a speaker unit 7403, a recording medium 7404 and an operation switch 7405. Note that by using DVD (digital versatile disc), CD, etc., as a recording medium of this device, music appreciation, film appreciation, games or the use for Internet can be performed.

Figure 16F:
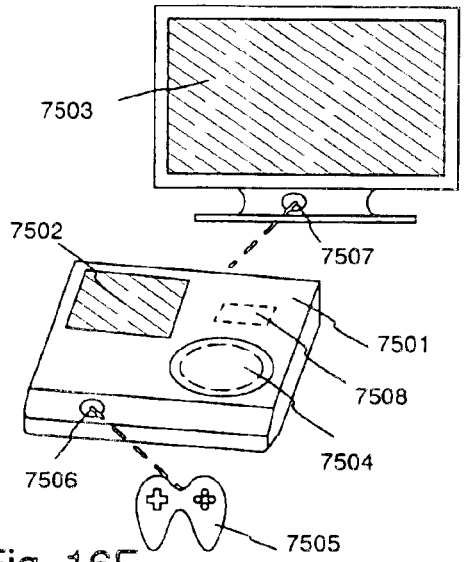
Figure 17:
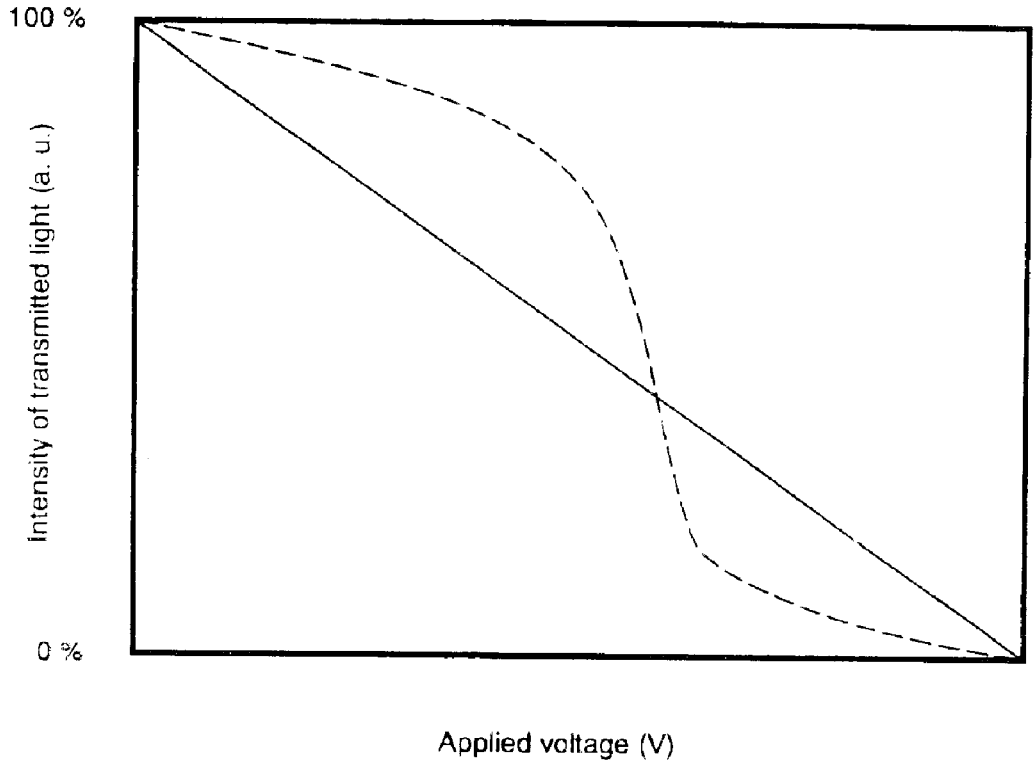
FIG. 17 is a diagram showing a characteristic of a liquid crystal panel.

FIG. 16F shows a game machine, which comprises: a main body 7501; a display device of the invention 7502; a display device 7503; a recording medium 7504; a controller 7505; a sensor unit for the main body 7506; a sensor unit 7507; and a CPU unit 7508. Each of the sensor unit for the main body 7506 and the sensor unit 7507 is capable of sensing the infrared ray emitted from the controller 7505 and the main body 7501.

As described above, the applicable range of the present invention is very large, and it can be applied to electronic appliances of various fields.

According to the display device of the present invention, the digital video signals are fed to the correction circuit, receive gamma correction based on the data contained in the gamma correction table stored in the correction memory, and are fed to the liquid crystal panel. Having thus been corrected properly, the digital signals fed to the liquid crystal panel produce a good quality image on the liquid crystal panel.

What is claimed is:

1. A display device comprising:

a display panel comprising a pixel portion in which a plurality of thin film transistors are arranged in a matrix, a digital video signal dividing circuit, a source driver circuit, and a gate driver circuit;

an image signal processing circuit for processing an image signal input from an external source; and a control circuit which feeds pulses to said digital video signal dividing circuit, said source driver circuit, said gate driver circuit and said image signal processing circuit, wherein said digital video signal dividing circuit is operationally connected to said control circuit, wherein said source driver circuit is operationally connected to said digital video dividing circuit, wherein said image signal processing circuit corrects said image signal on a basis of a correction table and feeds said digital video signal dividing circuit with a corrected image signal, and wherein said digital video signal dividing circuit feeds said source driver circuit with a digital video signal.

2. A display device according to claim 1, wherein said display panel is a liquid crystal display panel.

3. A display device according to claim 1, wherein said source driver circuit is a digital driver with a D/A conversion circuit.

4. A display device according to claim 1, wherein said image signal processing circuit comprises a correction circuit and an A/D conversion circuit.

5. A display device according to claim 1, wherein said display device is one selected from the group consisting of a projector, a goggle type display, a mobile computer, a video camera, a DVD player, and a game machine.

6. A display device comprising:

a display panel comprising a pixel portion in which a plurality of thin film transistors are arranged in a matrix, a digital video signal dividing circuit, a source driver circuit, and a gate driver circuit;

an image signal processing circuit for processing an image signal input from an external source; and a control circuit which feeds pulses to said digital video signal dividing circuit, said source driver circuit, said gate driver circuit and said image signal processing circuit, wherein said digital video signal dividing circuit is operationally connected to said control circuit, wherein said source driver circuit is operationally connected to said digital video dividing circuit, wherein said image signal processing circuit performs gamma correction on said image signal on a basis of a correction table and feeds said digital video signal dividing circuit with said image signal on which gamma correction has been performed, and wherein said digital video signal dividing circuit feeds said source driver circuit with a digital video signal.

7. A display device according to claim 6, wherein said display panel is a liquid crystal display panel.

8. A display device according to claim 6, wherein said source driver circuit is a digital driver with a D/A conversion circuit.

9. A display device according to claim 6, wherein said image signal processing circuit comprises a correction circuit and an A/D conversion circuit.

10. A display device according to claim 6, wherein said display device is one selected from the group consisting of a projector, a goggle type display, a mobile computer, a video camera, a DVD player, and a game machine.

11. A method for operating a display device comprising the steps of:

processing an image signal input from an external source by an image signal processing circuit;

feeding pulses to said image signal processing circuit, a digital video signal dividing circuit, a source driver circuit and a gate driver circuit by a control circuit, wherein a display panel comprises a pixel portion in which a plurality of thin film transistors are arranged in a matrix, said digital video signal dividing circuit, said source driver circuit, and said gate driver circuit;

correcting said image signal based on a correction table;

feeding a corrected image signal to said digital video signal dividing circuit through a correction circuit; and feeding a digital video signal to said source driver circuit through said digital video signal dividing circuit, wherein said digital video signal dividing circuit is operationally connected to said control circuit, wherein said source driver circuit is operationally connected to said digital video dividing circuit.

12. A method according to claim 11, wherein said display device is a liquid crystal display device.

13. A method according to claim 11, wherein said display device is one selected from the group consisting of a projector, a goggle type display, a mobile computer, a video camera, a DVD player, and a game machine.

14. A method for operating a display device comprising the steps of:

processing an image signal input from an external source by an image signal processing circuit;

feeding pulses to said image signal processing circuit, a digital video signal dividing circuit, a source driver circuit and a gate driver circuit by a control circuit, wherein a display panel comprises a pixel portion in which a plurality of thin film transistors are arranged in a matrix, said digital video signal dividing circuit, said source driver circuit, and said gate driver circuit;

performing a gamma correction of said image signal based on a correction table;

feeding a corrected image signal to said digital video signal dividing circuit through a correction circuit; and feeding a digital video signal to said source driver circuit through said digital video signal dividing circuit, wherein said digital video signal dividing circuit is operationally connected to said control circuit, wherein said source driver circuit is operationally connected to said digital video dividing circuit.

15. A method according to claim 14, wherein said display device is a liquid crystal display device.

16. A method according to claim 14, wherein said display device is one selected from the group consisting of a projector, a goggle type display, a mobile computer, a video camera, a DVD player, and a game machine.

17. A display device comprising:

a display panel comprising a pixel portion in which a plurality of thin film transistors are arranged in a matrix, a digital video signal dividing circuit, a source driver circuit, and a gate driver circuit, wherein each circuit is formed over a same substrate as said pixel portion;

an image signal processing circuit for processing an image signal input from an external source; and a control circuit which feeds pulses to said digital video signal dividing circuit, said source driver circuit, said gate driver circuit and said image signal processing circuit, wherein said digital video signal dividing circuit is operationally connected to said control circuit, wherein said source driver circuit is operationally connected to said digital video dividing circuit, wherein said image signal processing circuit corrects said image signal on a basis of a correction table and feeds said digital video signal dividing circuit with a corrected image signal, and wherein said digital video signal dividing circuit feeds said source driver circuit with a digital video signal.

18. A display device according to claim 17, wherein said display panel is a liquid crystal display panel.

19. A display device according to claim 17, wherein said source driver circuit is a digital driver with a D/A conversion circuit.

20. A display device according to claim 17, wherein said image signal processing circuit comprises a correction circuit and an A/D conversion circuit.

21. A display device according to claim 17, wherein said display device is one selected from the group consisting of a projector, a goggle type display, a mobile computer, a video camera, a DVD player, and a game machine.

22. A display device comprising:

a display panel comprising a pixel portion in which a plurality of thin film transistors are arranged in a matrix, a digital video signal dividing circuit, a source driver circuit, and a gate driver circuit, wherein each circuit is formed over a same substrate as said pixel portion;

an image signal processing circuit for processing an image signal input from an external source; and a control circuit which feeds pulses to said digital video signal dividing circuit, said source driver circuit, said gate driver circuit and said image signal processing circuit, wherein said digital video signal dividing circuit is operationally connected to said control circuit, wherein said source driver circuit is operationally connected to said digital video dividing circuit, wherein said image signal processing circuit performs gamma correction on said image signal on a basis of a correction table and feeds said digital video signal dividing circuit with said image signal on which gamma correction has been performed, and wherein said digital video signal dividing circuit feeds said source driver circuit with a digital video signal.

23. A display device according to claim 22, wherein said display panel is a liquid crystal display panel.

24. A display device according to claim 22, wherein said source driver circuit is a digital driver with a D/A conversion circuit.

25. A display device according to claim 22, wherein said image signal processing circuit comprises a correction circuit and an A/D conversion circuit.

26. A display device according to claim 22, wherein said display device is one selected from the group consisting of a projector, a goggle type display, a mobile computer, a video camera, a DVD player, and a game machine.

27. A display device according to claim 1, wherein said pulses comprises at least one selected from the group consisting of a start pulse, a clock pulse, and a synchronizing signal.

28. A display device according to claim 6, wherein said pulses comprises at least one selected from the group consisting of a start pulse, a clock pulse, and a synchronizing signal.

29. A method according to claim 11, wherein said pulses comprises at least one selected from the group consisting of a start pulse, a clock pulse, and a synchronizing signal.

30. A method according to claim 14, wherein said pulses comprises at least one selected from the group consisting of a start pulse, a clock pulse, and a synchronizing signal.

31. A display device according to claim 17, wherein said pulses comprises at least one selected from the group consisting of a start pulse, a clock pulse, and a synchronizing signal.

32. A display device according to claim 22, wherein said pulses comprises at least one selected from the group consisting of a start pulse, a clock pulse, and a synchronizing signal.

* * * * *